US010773526B2

(12) United States Patent
Kudo et al.

(10) Patent No.: US 10,773,526 B2
(45) Date of Patent: Sep. 15, 2020

(54) LIQUID EJECTING APPARATUS AND MAINTENANCE METHOD OF LIQUID EJECTING APPARATUS

(71) Applicant: SEIKO EPSON CORPORATION, Tokyo (JP)

(72) Inventors: Yasuyuki Kudo, Matsumoto (JP); Daisuke Matsumoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/580,681

(22) Filed: Sep. 24, 2019

(65) Prior Publication Data

US 2020/0094570 A1 Mar. 26, 2020

(30) Foreign Application Priority Data

Sep. 26, 2018 (JP) ..... 2018-179824

(51) Int. Cl.
*B41J 2/175* (2006.01)
*B41J 2/19* (2006.01)

(52) U.S. Cl.
CPC ..... *B41J 2/17556* (2013.01); *B41J 2/17513* (2013.01); *B41J 2/17596* (2013.01); *B41J 2/19* (2013.01)

(58) Field of Classification Search
CPC ..... B41J 2/17556; B41J 2/17513; B41J 2/17596; B41J 2/19
USPC ..... 347/84–86
See application file for complete search history.

(56) References Cited

U.S. PATENT DOCUMENTS

| | | | | |
|---|---|---|---|---|
| 7,992,981 | B2 * | 8/2011 | Yokouchi | B41J 2/17596 347/17 |
| 9,073,073 | B2 * | 7/2015 | Miyajima | B41J 2/17596 |
| 9,358,802 | B2 * | 6/2016 | Akahane | B41J 2/175 |
| 10,611,167 | B2 * | 4/2020 | Yamagishi | B41J 2/17513 |
| 2015/0273851 | A1 | 10/2015 | Akahane et al. | |
| 2015/0343793 | A1 | 12/2015 | Takada et al. | |

FOREIGN PATENT DOCUMENTS

| | | |
|---|---|---|
| JP | 2011-207236 | 10/2011 |
| JP | 2015-189201 | 11/2015 |
| JP | 2015-223828 | 12/2015 |

* cited by examiner

*Primary Examiner* — An H Do
(74) *Attorney, Agent, or Firm* — Workman Nydegger

(57) ABSTRACT

A liquid ejecting apparatus has a liquid-chamber, a fluid-chamber, a flexible member that includes a film and a first-seal-portion and that separates the liquid-chamber and the fluid-chamber, and a pressurizing section which supplies a fluid to the fluid-chamber to pressurize the flexible member toward the liquid-chamber. The fluid-chamber is configured such that a first-seal-portion being provided in the fluid-chamber and the first-seal-portion come into contact with each other to be partitioned into a first-fluid-chamber having an introduction port through which the fluid flows in and a-second-fluid-chamber. The pressurizing section converts, by the supply of the fluid to the fluid-chamber, a state of the fluid-chamber into a first-state in which the first-contact-portion and the first-seal-portion come into contact with each other or a second-state in which the contact between the first-contact portion and the first-seal-portion is released so that the first-fluid-chamber and the second-fluid-chamber communicate with each other.

20 Claims, 9 Drawing Sheets

LIQUID EJECTING APPARATUS AND MAINTENANCE METHOD OF LIQUID EJECTING APPARATUS

The present application is based on, and claims priority from JP Application Ser. No. 2018-179824, filed Sept. 26, 2018, the disclosure of which is hereby incorporated by reference herein in its entirety.

BACKGROUND

1. Technical Field

The present disclosure relates to, for example, a liquid ejecting apparatus including a pressure adjustment section that adjusts a supply pressure of a liquid supplied to a liquid ejecting head, and a method of maintaining a liquid ejecting apparatus.

2. Related Art

A liquid ejecting head is configured to receive supply of a liquid from a liquid supply member and to eject the liquid from a nozzle by driving an actuator such as a piezoelectric element. The liquid ejecting apparatus provided with the liquid ejecting head includes a pressure adjustment mechanism that includes a liquid chamber having an introduction port through which a liquid from the liquid supply member flows in and an outlet communicating with a liquid ejecting head side in an intermediate of a flow path from the liquid supply member to the nozzle of the liquid ejecting head, an air chamber into which air is capable of flowing, a flexible member that separates the liquid chamber from the air chamber. The pressure adjustment mechanism pressurizes the air chamber by sending air into the air chamber and deforms the flexible member toward the liquid chamber to send out the liquid in the liquid chamber from the outlet to the liquid ejecting head side (see, for example, JP-A-2015-189201). According to the configuration of JP-A-2015-189201, it is possible to perform pressure cleaning, which is a maintenance operation for forcibly discharging the liquid or air bubbles from the nozzle of the liquid ejecting head, using the pressure adjustment section.

In the pressure adjustment section of JP-A-2015-189201, a total amount (hereinafter simply referred to as a discharge amount) of the liquid discharged from each nozzle at the time of the pressure cleaning is determined in accordance with a deformation amount of the flexible member, but it is difficult to adjust the deformation amount of the flexible member. Therefore, for example, it has been difficult to perform a plurality of pressure cleanings with different discharge amounts of the liquid with a simple configuration without using a pressure sensor or the like.

SUMMARY

According to an aspect of the present disclosure, there is provided a liquid ejecting apparatus including: a liquid ejecting unit ejecting a liquid from a nozzle; and a pressure adjustment section adjusting a pressure of the liquid to be supplied to the liquid ejecting unit, in which the pressure adjustment section includes a liquid chamber communicating with the liquid ejecting unit and storing the liquid to be supplied to the liquid ejecting unit, a fluid chamber into which a fluid is capable of flowing, a flexible member that includes an elastically deformable film and a first seal portion provided in the film, the flexible member being interposed between the liquid chamber and the fluid chamber to separate the liquid chamber and the fluid chamber from each other, and a pressurizing section that supplies the fluid to the fluid chamber and pressurizes the flexible member toward the liquid chamber with the fluid, the fluid chamber includes a first contact portion configured to come into contact with the first seal portion, and the fluid chamber is configured such that the first contact portion and the first seal portion come into contact with each other so as to be partitioned into a first fluid chamber having an introduction port through which the fluid flows in and a second fluid chamber, and the pressurizing section converts, by supplying the fluid to the fluid chamber, a state of the fluid chamber into a first state in which the first contact portion and the first seal portion are in contact with each other, or a second state in which the contact between the first contact portion and the first seal portion is released so that the first fluid chamber and the second fluid chamber communicate with each other.

DESCRIPTION OF EXEMPLARY EMBODIMENTS

Hereinafter, embodiments for executing the present disclosure will be described with reference to the attached drawings. In the embodiments described below, various limitations are given as preferable specific examples of the present disclosure, but the scope of the present disclosure is not limited to these embodiments unless specifically stated in the following description to limit the present disclosure. Further, the following description will be made by taking an ink jet printer (hereinafter, printer) 1 as a liquid ejecting apparatus equipped with an ink jet recording head (hereinafter, recording head) 10 which is a type of the liquid ejecting head.

Figure 1:
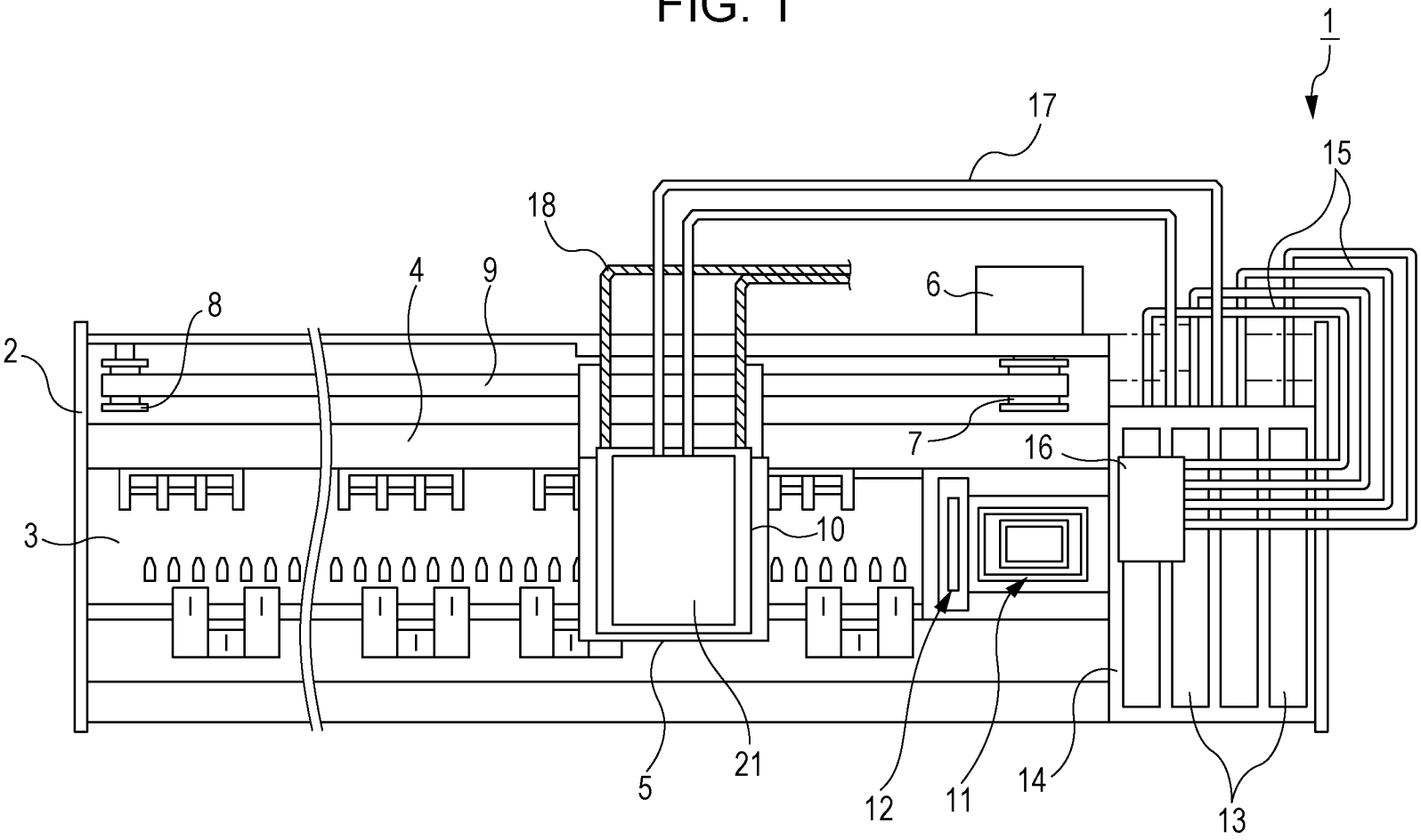
FIG. 1 is a plan view for explaining a configuration of an embodiment of a liquid ejecting apparatus.

FIG. 1 is a plan view illustrating a configuration of an embodiment of the printer 1. The printer 1 in the present embodiment is an apparatus that ejects liquid ink (a type of the liquid in the present disclosure) from the recording head 10 onto a surface of a recording medium such as a recording sheet, cloth, or a resin film to record an image, a text, or the like. The printer 1 includes a frame 2 and a platen 3 disposed in the frame 2, and the recording medium is transported onto the platen 3 by a transport mechanism (not illustrated). Further, in the frame 2, a guide rod 4 is provided in parallel with the platen 3, and a carriage 5 accommodating the recording head 10 is slidably supported by the guide rod 4. The carriage 5 is configured to reciprocate in a main scanning direction orthogonal to a paper feeding direction along the guide rod 4 by a carriage moving mechanism. The carriage moving mechanism includes a pulse motor 6, a drive pulley 7 which is rotated by driving of the pulse motor 6, an idle pulley 8 provided on an opposite side to the drive pulley 7 in the frame 2, and a timing belt 9 provided between the drive pulley 7 and the idle pulley 8. The printer 1 in the embodiment ejects ink from a nozzle 30 (see FIG. 3 or the like) of the recording head 10 while causing the carriage 5 to reciprocate relative to the recording medium, and performs a recording operation, that is, a liquid ejecting operation.

A cartridge holder 14 for detachably mounting an ink cartridge 13 which is a type of a liquid supply member is provided on one side of the frame 2. The ink cartridge 13 is coupled to an air pump 16 via an air tube 15, and air from the air pump 16 is supplied into each ink cartridge 13. An ink pack (not illustrated) disposed in the ink cartridge 13 is pressurized by the pressurized air, so that the ink in the ink pack is supplied to the recording head 10 side through the ink supply tube 17. The air pump 16 is configured to be capable of selectively executing a pressurizing operation that feeds air into a flow path or a space coupled to the air pump 16, and a depressurizing operation that sucks the air from the flow path or the like in accordance with an instruction from the control section (not illustrated) of the printer 1. The air pump 16 is configured to be capable of switching the coupling to a capping mechanism 11 described later and gas flow paths 59 and 64 of a flow path unit 21 described later, in addition to the ink cartridge 13. That is, the air pump 16 functions as a pressurizing section that pressurizes a fluid chamber 58 of a pressure adjustment section 54 through the gas flow path 59 of the flow path unit 21.

The ink sent from the ink supply tube 17 from the ink cartridge 13 is first introduced into the flow path unit 21 of the recording head 10 mounted on the carriage 5. The ink introduced into the flow path unit 21 is supplied to an ink flow path inside the liquid ejecting unit 23 via a self-sealing unit 22, a flow path opening/closing section 55, and the pressure adjustment section 54, which are described later. In addition, as the liquid supply member, it is not limited to the illustrated one, and various structures such as a cartridge type, a pack type, a tank type can be adopted. The ink supply tube 17 is, for example, a flexible hollow member made of a synthetic resin, and an ink flow path corresponding to each ink cartridge 13 is formed inside the ink supply tube 17. In addition, an flexible flat cable (FFC) 18 for transmitting a drive signal or the like from the control section (not illustrated) on a main body side of the printer 1 to the recording head 10 side is wired between the main body side of the printer 1 and the recording head 10 side.

The capping mechanism 11 for sealing a nozzle formation surface of the recording head 10 and a wiping mechanism 12 for wiping the nozzle formation surface of the recording head 10 are disposed in parallel at a home position provided on one side (cartridge holder 14 side) in a movement range of the recording head 10 inside the frame 2. The capping mechanism 11 seals a surface on which the nozzle 30 of the recording head 10 in a standby state at the home position is formed, and suppresses the evaporation of a solvent of the ink from the nozzle 30. In addition, the capping mechanism 11 functions as a receptacle for the ink or the like discharged from the nozzle 30 of the recording head 10 in pressure cleaning which is a maintenance operation described later. The wiping mechanism 12 is a mechanism that performs a wiping operation that wipes off the ink or the like attached to the nozzle forming surface by relatively moving in a state of being in contact with the nozzle forming surface.

Figure 2:
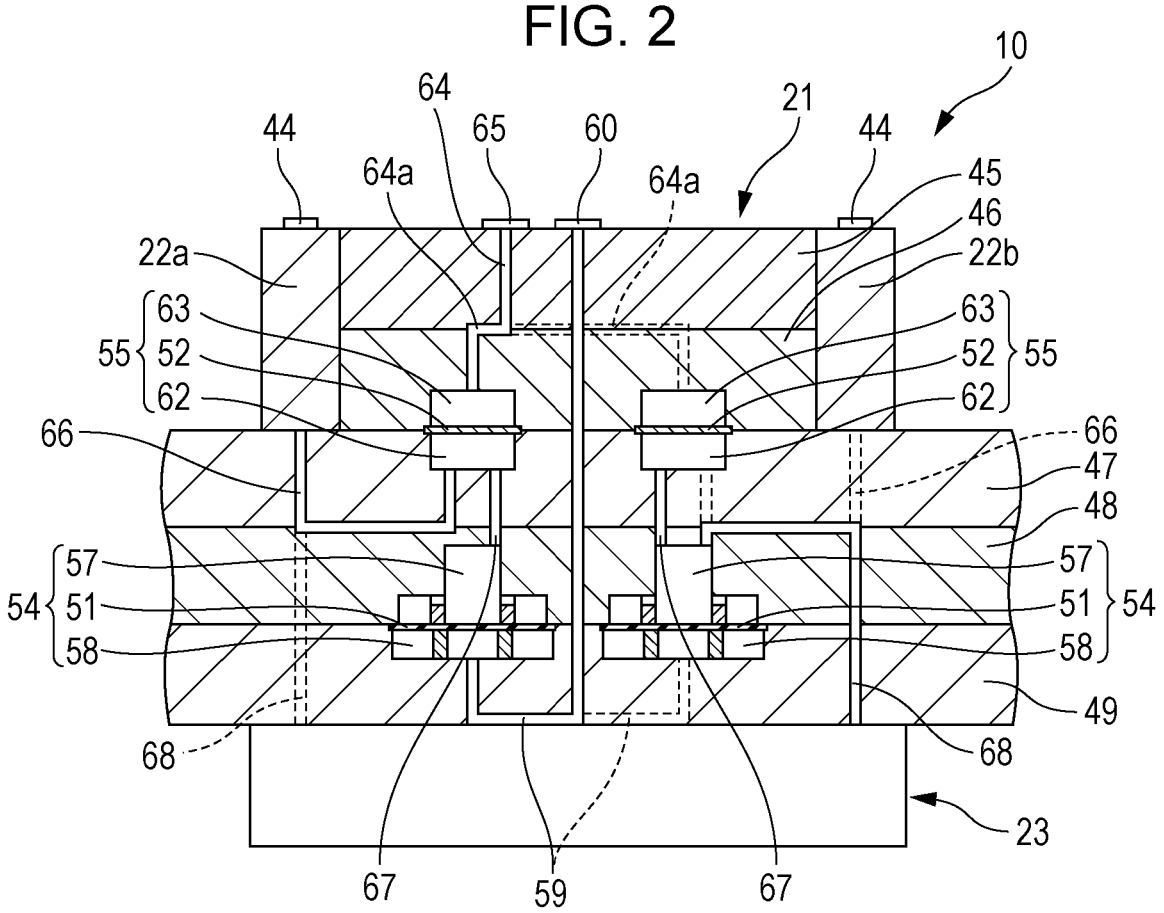
FIG. 2 is a sectional view for explaining a configuration of an embodiment of a liquid ejecting head.

FIG. 2 is a sectional view for explaining a configuration of the recording head 10. The recording head 10 in the present embodiment is formed as one unit combining the flow path unit 21 in which self-sealing units 22*a* and 22*b* to which two colors of ink are supplied and four types of flow paths corresponding to respective colors corresponding to four colors of ink, for example, black (K), cyan (C), magenta (M), and yellow (Y), and the liquid ejecting unit 23 (a type of liquid ejecting unit in the present disclosure).

Figure 3:
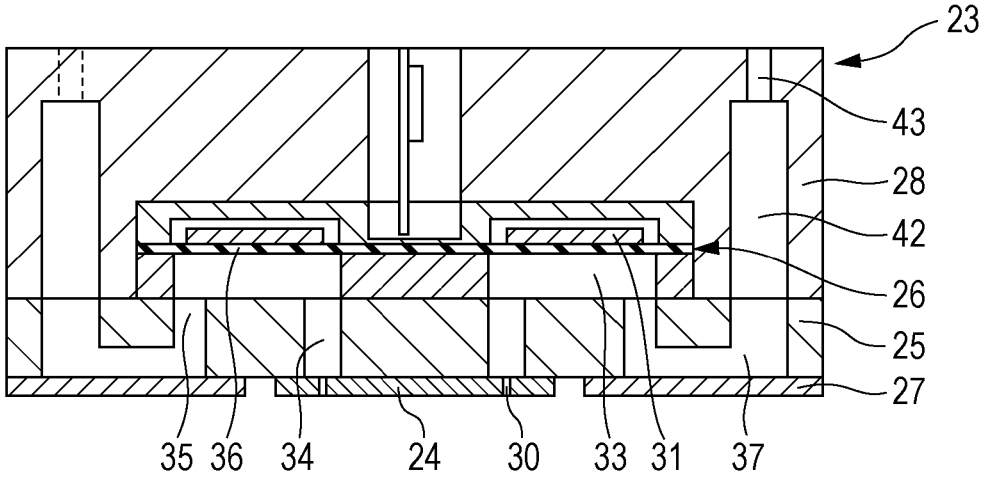
FIG. 3 is a sectional view for explaining a configuration of an embodiment of the liquid ejecting unit.

FIG. 3 is a sectional view for explaining an example of the configuration of the liquid ejecting unit 23. The liquid ejecting unit 23 in the present embodiment is formed by stacking a plurality of constituent members such as a nozzle plate 24, a communication plate 25, an actuator substrate 26, a compliance substrate 27, and a case 28, and joining them with an adhesive or the like.

The actuator substrate 26 in the present embodiment includes a plurality of pressure chambers 33 respectively communicating with a plurality of nozzles 30 formed on the nozzle plate 24, and a plurality of piezoelectric elements 31 which are actuators that generate pressure fluctuation in the ink in each pressure chamber 33. A vibration plate 36 is provided between the pressure chamber 33 and the piezoelectric element 31, and an upper opening of the pressure chamber 33 is sealed by the vibration plate 36 to partition a part of the pressure chamber 33. The vibration plate 36 is made of, for example, an elastic film formed of silicon dioxide ($SiO_2$) and an insulator film formed of zirconium oxide ($ZrO_2$) formed on the elastic film. The piezoelectric elements 31 are respectively stacked in regions corresponding to the respective pressure chambers 33 on the vibration plate 36. The piezoelectric element 31 in the present embodiment is, for example, formed by sequentially stacking a lower electrode layer, a piezoelectric layer, and an upper electrode layer (all are not illustrated) on the vibration plate 36. The piezoelectric element 31 configured in this manner is bent and deformed when an electric field corresponding to a potential difference of both electrodes between the lower electrode layer and the upper electrode layer is applied.

The communication plate 25 having a larger area than that of the actuator substrate 26 in a plan view seen from the substrate stacking direction is joined to the lower surface of the actuator substrate 26. In the communication plate 25 in the present embodiment, a nozzle communication port 34 causing the pressure chamber 33 to communicate with the nozzle 30, a common liquid chamber 37 provided in common to respective pressure chambers 33, and an individual communication port 35 causing the common liquid chamber 37 to communicate with the pressure chamber 33 are formed. The common liquid chamber 37 is an empty portion extending in a direction in which the nozzles 30 are provided in parallel. In the present embodiment, two common liquid chambers 37 are formed corresponding to each row of two nozzles 30 provided in the nozzle plate 24. A plurality of individual communication ports 35 are formed corresponding to the respective pressure chambers 33 in a nozzle row direction. The individual communication port 35 communicates with an end portion of the pressure chamber 33 on a side opposite to a portion communicating with the nozzle communication port 34.

The nozzle plate 24 in which the plurality of nozzles 30 are formed is joined to a substantially central portion of a lower surface of the communication plate 25. The nozzle plate 24 in the present embodiment is a plate member having an outer shape smaller than the communication plate 25 in a plan view. The nozzle plate 24 is located at a position deviated from an opening of the common liquid chamber 37 on the lower surface of the communication plate 25, and is joined to a region where the nozzle communication port 34 is open in a state in which the nozzle communication ports 34 and the plurality of nozzles 30 communicate with each other. In the nozzle plate 24 in the present embodiment, a total of two nozzle rows in which the plurality of nozzles 30 are provided in parallel is formed. Further, the compliance substrate 27 is joined at a position deviated from the nozzle plate 24 on the lower surface of the communication plate 25. The compliance substrate 27 seals the opening of the common liquid chamber 37 on the lower surface of the communication plate 25 in a state of being positioned and joined to the lower surface of the communication plate 25. The compliance substrate 27 has a function of alleviating pressure fluctuation in the ink flow path, particularly in the common liquid chamber 37.

The actuator substrate 26 and the communication plate 25 are fixed to the case 28. In the inside of the case 28, introduction liquid chambers 42 communicating with the common liquid chambers 37 of the communication plate 25 are formed on both sides with the actuator substrate 26 interposed therebetween. Further, an inlet 43 communicating with each introduction liquid chamber 42 is open on an upper surface of the case 28. The inlet 43 communicates with a third flow path 68 of the flow path unit 21 described later. Therefore, the ink sent from the flow path unit 21 is introduced into the inlet 43, the introduction liquid chamber 42, and the common liquid chamber 37, and is supplied from the common liquid chamber 37 to each pressure chambers 33 through the individual communication ports 35. In the liquid ejecting unit 23 configured as described above, the piezoelectric element 31 is driven in a state in which the inside of the flow path from the introduction liquid chamber 42 to the nozzle 30 through the common liquid chamber 37 and the pressure chamber 33 is filled with ink. Therefore, pressure fluctuation occurs in the ink in the pressure chamber 33, and the ink is ejected from a predetermined nozzle 30 by the pressure fluctuation (in other words, pressure vibration). The recording head 10 is not limited to the illustrated configuration, and various known configurations can be adopted. For example, a liquid ejecting head configured to circulate ink with the liquid supply member can be adopted. Also, it is also possible to adopt a so-called line type liquid ejecting head which has a unit head group in which a plurality of unit heads are arranged in a direction intersecting a transport direction of the recording medium, and in which an entire length of the nozzle group formed by the unit head group corresponds to a maximum recording width of the recording medium.

The self-sealing unit 22 is a unit that receives the ink, which is sent from the ink cartridge 13 side through the ink supply tube 17, from the supply port 44 and regulates the supply of the ink to the liquid ejecting unit 23 side of the ink. In the self-sealing unit 22, when a negative pressure in the pressure adjustment chamber (not illustrated) exceeds a predetermined value as the ink is ejected from the liquid ejecting unit 23, a closed liquid flow path is opened. Therefore, the ink is supplied to the liquid ejecting unit 23 side.

The flow path unit 21 includes a first flow path substrate 45, a second flow path substrate 46, a third flow path substrate 47, a fourth flow path substrate 48, a fifth flow path substrate 49, a flexible member 51, and a flow path opening/closing film 52 which are stacked. Further, the flow path unit 21 has the pressure adjustment section 54 and a flow path opening/closing section 55. The pressure adjustment section 54 is provided in a middle of the liquid flow path between the self-sealing unit 22 and the liquid ejecting unit 23, and has a function of adjusting the pressure in the liquid flow path by changing a volume of the liquid flow path. In addition, the flow path opening/closing section 55 is located in the middle of the liquid flow path between the self-sealing unit 22 and the pressure adjustment section 54, and has a function of opening and closing the liquid flow path.

In the flow path unit 21, a liquid chamber 57 (a type of the liquid chamber in the present disclosure) is formed on the lower surface of the fourth flow path substrate 48 on the fifth flow path substrate 49 side. A fluid chamber 58 (a type of the fluid chamber in the present disclosure) corresponding to the liquid chamber 57 is formed on the upper surface of the fifth flow path substrate 49 on the fourth flow path substrate 48 side. A flexible member 51 (a type of the flexible member in the present disclosure) formed of an elastic material such as rubber is interposed between the liquid chamber 57 and the fluid chamber 58. Therefore, the liquid chamber 57 and the fluid chamber 58 are partitioned, that is, separated by the flexible member 51. As described later, the volume of the liquid chamber 57 can be changed by the deformation of the flexible member 51 in a stacking direction of the flow path substrate. The flexible member 51 functions as a pressure adjustment film. The liquid chamber 57 in the present embodiment can be said to be an ink chamber. Similarly, the fluid chamber 58 in the present embodiment can be said to be a gas chamber.

Figure 4:
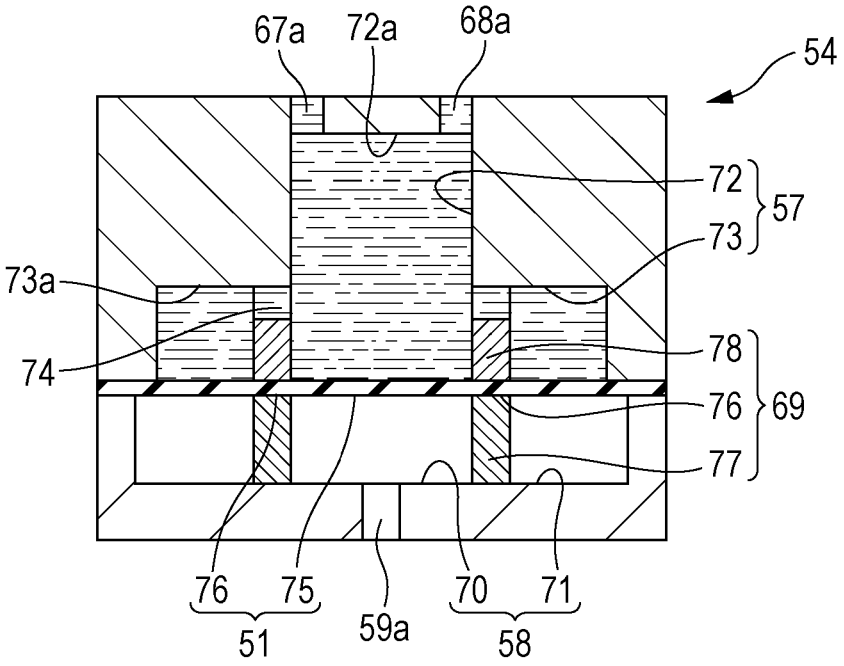
FIG. 4 is a sectional view for explaining a configuration of a pressure adjustment section.

The gas flow path 59 opened on the upper surface of the first flow path substrate 45 penetrates the flow path substrates 45, 46, 47, and 48 to reach the lower surface of the fifth flow path substrate 49, and further, communicates with the fluid chamber 58 from the lower surface side through a vent 59*a* (see FIG. 4 or the like). The gas supply port 60 provided on the upper surface of the first flow path substrate 45 and the fluid chamber 58 communicate with each other by the gas flow path 59. Therefore, a deformation amount of the flexible member 51 can be adjusted by adjusting an amount of gas (that is, air or the like) which is a type of the fluid supplied from the air pump 16 through the gas supply port 60. As described later, the liquid chamber 57 communicates with the third flow path 68, which is an ink flow path, through the ink outlet 68*a* (see FIG. 4). That is, the liquid chamber 57, the fluid chamber 58, and the flexible member 51 form the pressure adjustment section 54 that adjusts the pressure in the ink flow path. Such a pressure adjustment section 54 is provided for each type of ink (for example, for each color of ink). Details of the pressure adjustment section 54 will be described later.

A first recess portion 62 is formed on the upper surface of the third flow path substrate 47, and a second recess portion 63 corresponding to the first recess portion 62 is formed on the lower surface of the second flow path substrate 46. The flow path opening/closing film 52 formed of an elastic material similar to the flexible member 51 is interposed between the first recess portion 62 and the second recess portion 63. Therefore, the first recess portion 62 and the second recess portion 63 are partitioned by the flow path opening/closing film 52. The flow path can be closed or opened by the deformation of the flow path opening/closing film 52 in the substrate stacking direction. That is, the flow path opening/closing film 52 is deformed so as to bend toward the first recess portion 62, and the flow path is closed by coming into contact with and sealing a bottom surface of the first recess portion 62. Further, the flow path opening/closing film 52 is deformed so as to bend toward the second recess portion 63, and the seal between the flow path opening/closing film 52 and the bottom surface of the first recess portion 62 is released, so that the flow path is opened. The gas flow path 64 opened on the upper surface of the first flow path substrate 45 penetrates the first flow path substrate 45 to reach the upper surface of the second flow path substrate 46. A horizontal flow path 64*a* is formed on the upper surface of the second flow path substrate 46, and the gas flow path 64 communicates with the second recess portion 63 via the horizontal flow path 64*a*. Therefore, the gas flow path 64 from the gas supply port 65 provided on the upper surface of the first flow path substrate 45 to the second recess portion 63 is communicated. Therefore, when the gas is supplied from the air pump 16 through the gas supply port 65, the flow path opening/closing film 52 can be deformed to open/close the flow path. The first recess portion 62 communicates with the first flow path 66 which is an ink flow path. That is, the first recess portion 62, the second recess portion 63, and the flow path opening/closing film 52 form the flow path opening/closing section 55 that opens and closes the ink flow path. Similar to the pressure adjustment section 54, such a flow path opening/closing section 55 is provided for each ink type (for example, for each ink color).

In the flow path unit 21, a first flow path 66, a second flow path 67, and a third flow path 68 are formed as ink flow paths. The first flow path 66 is an ink flow path for introducing the ink supplied from one of the self-sealing units 22 into the first recess portion 62. The second flow path 67 is an ink flow path communicating with the first recess portion 62 and the liquid chamber 57. The third flow path 68 is an ink flow path communicating with the liquid chamber 57 and the inlet 43 of the liquid ejecting unit 23. That is, the third flow path 68 liquid-tightly communicates with the inlet 43 of the liquid ejecting unit 23 on the lower surface of the fifth flow path substrate 49.

In such a flow path unit 21, the flow path opening/closing section 55 is disposed between the first flow path 66 and the second flow path 67 in the ink flow path from the self-sealing unit 22 to the liquid ejecting unit 23. The pressure adjustment section 54 is disposed between the second flow path 67 and the third flow path 68. The flow path unit 21 adjusts the pressure of the ink in the ink flow path with the pressure adjustment section 54, and opens and closes a space between the pressure adjustment section 54 and the self-sealing unit 22 with the flow path opening/closing section 55. In addition, the pressure adjustment section 54 causes the gas from the air pump 16 to flow into the fluid chamber 58 and deforms the flexible member 51 so as to bend to the liquid chamber 57 side. Therefore, it is possible to perform pressure cleaning in which the ink in the liquid chamber 57 is extruded to be sent to the liquid ejecting unit 23 side and the ink, bubbles, or the like in the liquid ejecting unit 23 is forcibly discharged from each nozzles 30 of the liquid ejecting unit 23. In this case, prior to pressurization by the pressure adjustment section 54, the flow path is closed by the flow path opening/closing section 55.

Here, in order to perform the pressure cleaning more efficiently, that is, in order to suppress waste of an amount of ink consumed in the pressure cleaning, it is desirable that the cleaning operation of a plurality of patterns having different discharge amounts of the ink discharged from the recording head 10 can be selectively performed by the pressure cleaning according to the state and purpose of the printer 1 and the recording head 10. For example, in the cleaning operation for the purpose of removing foreign matter such as paper dust adhering to the vicinity of the nozzle 30 on the nozzle formation surface, the consumption amount of the ink can be reduced by executing the cleaning operation with a relatively small discharge amount. Further, for example, in the cleaning operation for the purpose of discharging air bubbles, thickened ink, or the like at a position relatively close to the nozzles 30 in the flow path inside the liquid ejecting unit 23, it is necessary to further increase the discharge amount. Furthermore, for example, in the cleaning operation for the purpose of discharging air bubbles or the like in the flow path from the pressure adjustment section 54 to the liquid ejecting unit 23, it is necessary to further increase the discharge amount. Therefore, when it is only possible to execute pressure cleaning with a constant discharge amount of ink, the discharge amount may be excessive or insufficient depending on the state and purpose of the printer 1 and the recording head 10, which is not efficient.

Therefore, for example, it is also conceivable to control the discharge amount of the ink in the pressure cleaning by detecting the deformation amount of the flexible member 51 in the liquid chamber 57 in the pressure adjustment section 54 by a photosensor. However, the photosensor can only detect a specific deformation amount, and it is necessary to provide a plurality of photosensors in order to detect a plurality of deformation amounts, resulting in a problem that the configuration is complicated and the cost is also increased. Similarly, it is also conceivable to control the discharge amount of ink at the time of the pressure cleaning by adjusting a pressure inside the fluid chamber 58 using a pressure sensor or the like capable of detecting the pressure inside the fluid chamber 58. However, provision of a pressure sensor capable of always detecting the pressure inside the fluid chamber 58 leads to an increase in cost.

Further, for example, it is also conceivable to adjust the discharge amount at the time of the pressure cleaning by controlling a driving time of the air pump 16 for feeding the gas into the fluid chamber 58, that is, a driving time of the pressurizing section without providing various sensors as described above. However, when the discharge amount is changed by the driving time of the pressurizing section in the configuration or the related art, there is a problem that it is easily affected by dimensional error, temperature, or the like of the structure, and an error easily occurs as compared with a case where the discharge amount is adjusted using a sensor. In view of such a problem, in the printer 1 according to the present disclosure, a plurality of pressure cleanings with different discharge amounts of the ink can be performed more accurately by controlling the driving time of the air pump 16, that is, the driving time of the pressurizing section. Hereinafter, this point will be described.

Figure 5:
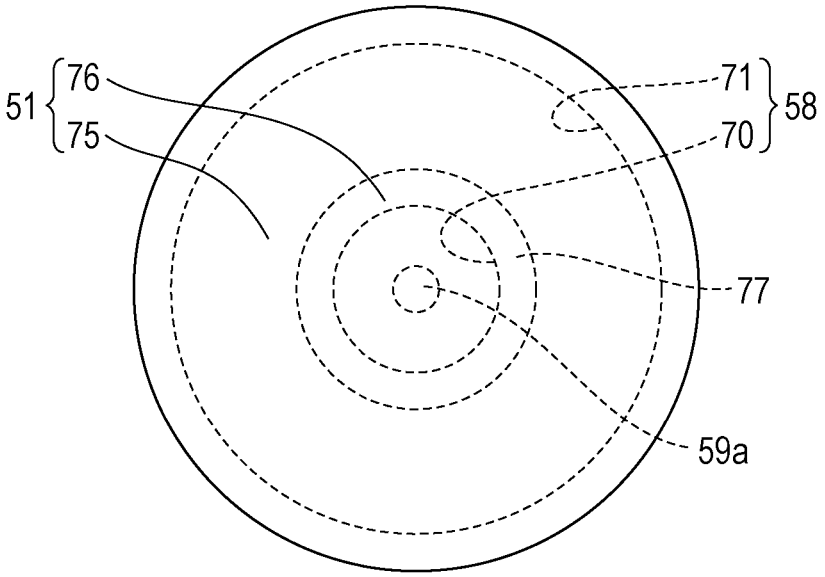
FIG. 5 is a plan view for explaining a configuration of a fluid chamber side in the pressure adjustment section.
Figure 6:
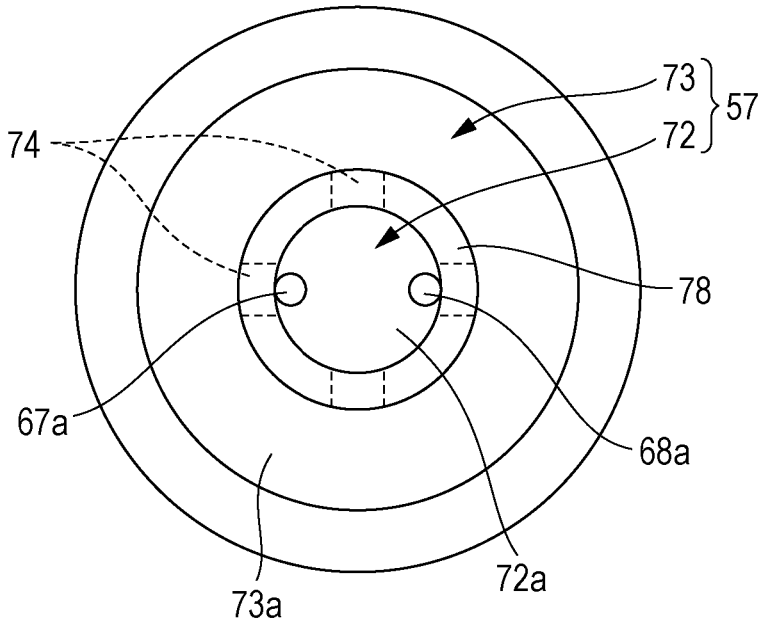
FIG. 6 is a plan view for explaining a configuration of a liquid chamber side in the pressure adjustment section.

FIG. 4 is a sectional view for explaining a configuration of the pressure adjustment section 54, FIG. 5 is a plan view for explaining a configuration of the fluid chamber 58 side (that is, a portion corresponding to the fluid chamber 58 on the upper surface of the fifth flow path substrate) in the pressure adjustment section 54, and FIG. 6 is a plan view for explaining a configuration of the liquid chamber 57 side (that is, a portion corresponding to the liquid chamber 57 on the lower surface of the fourth flow path substrate) in the pressure adjustment section 54. A normal state in which the pressure cleaning is not performed, a state in which the pressure inside the fluid chamber 58 and the pressure inside the liquid chamber 57 are balanced, or a state in which the pressure inside the fluid chamber 58 is lower than that of the state is illustrated in FIG. 4.

In the present embodiment, the fluid chamber 58 formed in the fifth flow path substrate 49 is a recess portion having a circular shape in a plan view as viewed in the stacking direction of the flow path substrate, and is open to the liquid chamber 57 side of the fourth flow path substrate 48. The opening of the fluid chamber 58 is sealed by the flexible member 51. The vent 59*a* (a type of the introduction port in the present disclosure) communicating with the gas flow path 59 is open at a center portion of the bottom of the fluid chamber 58. Therefore, the inside of the fluid chamber 58 can be depressurized or pressurized by the gas flowing out or flowing into the fluid chamber 58 through the gas flow path 59 and the vent 59*a* by driving the air pump 16. Therefore, the flexible member 51 sealing the opening of the fluid chamber 58 is deformed to bend in the stacking direction of the flow path substrate. Although the fluid chamber 58 in the present embodiment is configured as a space into which the gas that is a type of the fluid, that is, air flows, it can be a fluid chamber into which a liquid as a type of the fluid flows. That is, a configuration can be adopted in which the flexible member is pressurized by a fluid such as a liquid flowing into the fluid chamber.

A rib-like support member 77 for supporting the flexible member 51 is erected on the bottom surface of the fluid chamber 58 toward the liquid chamber 57 in a state of surrounding a periphery of the vent 59*a*. The support member 77 comes into contact with the seal portion 76 of the flexible member 51 described later to partition the fluid chamber 58 into a first fluid chamber 70 (corresponding to the first fluid chamber in the present disclosure) having the vent 59*a* and a second fluid chamber 71 (corresponding to the second fluid chamber in the present disclosure). The support member 77 in the present embodiment has an annular shape centering on the vent 59*a* in a plan view. A top surface (surface facing the liquid chamber 57) of the support member 77 functions as a first contact portion capable of coming into contact with the seal portion 76 of the flexible member 51.

The liquid chamber 57 in the present embodiment is configured by concentrically forming a first liquid chamber 72 and a second liquid chamber 73, which are cylindrical recess portions having different depths and inner diameters. Specifically, the second liquid chamber 73 is a liquid chamber of which the inner diameter is substantially equal to an opening diameter of the fluid chamber 58 and of which the depth is set to be relatively shallow. On the other hand, the first liquid chamber 72 is a liquid chamber of which the inner diameter is set smaller than that the second liquid chamber 73 and of which the depth is set deeper than that of the second liquid chamber 73. Therefore, a step is generated between the first liquid chamber 72 and the second liquid chamber 73, and the stepped portion functions as a ceiling surface 73*a* of the second liquid chamber 73. A regulation member 78 is provided on the ceiling surface 73*a* of the second liquid chamber 73 so as to protrude toward the fluid chamber 58.

The regulation member 78 in the present embodiment has an annular shape in a plan view corresponding to the support member 77 of the fluid chamber 58, and the seal portion 76 of the flexible member 51 is pinched between a lower surface of the regulation member 78 on the support member 77 side and a top surface of the support member 77. The regulation member 78 is provided on the liquid chamber 57 side to regulate the deformation of the seal portion 76 of the flexible member 51 to the liquid chamber 57 side. That is, the regulation member 78 functions as a bias member that biases the seal portion 76 of the flexible member 51 toward the support member 77. A communication portion 74 penetrating in a wall thickness direction is formed on the ceiling surface 73*a* side of the regulation member 78, and the first liquid chamber 72 and the second liquid chamber 73 communicate with each other through the communication portion 74. A set of the support member 77, the seal portion 76, and the regulation member 78 in the present embodiment constitutes a partition structure 69 that partitions the fluid chamber 58 into the first fluid chamber 70 and the second fluid chamber 71. Although the regulation member 78 in the present embodiment is configured to be supported by the ceiling surface 73*a* of the second liquid chamber 73, the present disclosure is not limited thereto. For example it is also possible to adopt a configuration supported by a support member in a form of a beam from a side wall of the liquid chamber 57.

An ink inlet 67*a* communicating with the second flow path 67 and an ink outlet 68*a* communicating with the third flow path 68 are open on the ceiling surface 72*a* of the first liquid chamber 72. In a state in which the flow path opening/closing section 55 is opened, the ink from the self-sealing unit 22 side is introduced into the liquid chamber 57 through the ink inlet 67*a* via the flow path opening/closing section 55. Further, in a state in which the flow path opening/closing section 55 is closed, when air is fed into the fluid chamber 58 by driving of the air pump 16 so that the flexible member 51 is pressurized toward the liquid chamber 57 by the air and is deformed to bend, the ink in the liquid chamber 57 is drawn out from the ink outlet 68*a* to the liquid ejecting unit 23 side through the third flow path 68.

As described above, the flexible member 51 is a flexible film-like member made of an elastic material. In the flexible member 51 of the present embodiment, a portion being in contact with the support member 77 is the seal portion 76 (a type of the first seal portion in the present disclosure), and the other portion is the film 75 (a type of the film in the present disclosure). A thickness of the seal portion 76 is set to be equal to or greater than a distance (in other words, an interval) between the lower surface (regulation surface) of the regulation member 78 on the support member 77 side and the top surface of the support member 77 in a state in which the seal portion 76 does not come into contact with any of the support member 77 and the regulation member 78. Therefore, in a first state described below, the seal portion 76 is in a crushed state between the lower surface (regulation surface) of the regulation member 78 on the support member 77 side and the top surface of the support member 77, and adhesion is increased, so that the first fluid chamber 70 and the second fluid chamber 71 can be more reliably shut off.

In the pressure adjustment section 54 having such a configuration, it is configured to be convertible to the first state in which the support member 77 of the fluid chamber 58 and the seal portion 76 of the flexible member 51 come into contact with each other to be sealed, and the first fluid chamber 70 and the second fluid chamber 71 do not communicate with each other in the fluid chamber 58, and a state in which the support member 77 and the seal portion 76 come into contact with each other, that is, the second state in which the sealed state is released, and the first fluid chamber 70 and the second fluid chamber 71 communicate with each other. Therefore, as described below, it is possible to be switched to the first state in which the ink in the liquid chamber 57 is pressurized only by the film 75 of the portion corresponding to the first fluid chamber 70, and the second state in which the ink in the liquid chamber 57 is pressurized by the film 75 of the portions corresponding to the first fluid chamber 70 and the second fluid chamber 71. It is configured to be capable of executing a plurality of pressure cleanings with different discharge amounts of the ink. Although the flexible member 51 is illustrated as being parallel to the opening surface of the fluid chamber 58 as a whole in FIG. 4, the film 75 in the flexible member 51 may be slightly bent to the fluid chamber 58 side.

Hereinafter, a maintenance operation (in other words, pressure cleaning) for forcibly discharging ink and air bubbles from the nozzles 30 of the recording head 10 using the pressure adjustment section 54 will be described.

Figure 7:
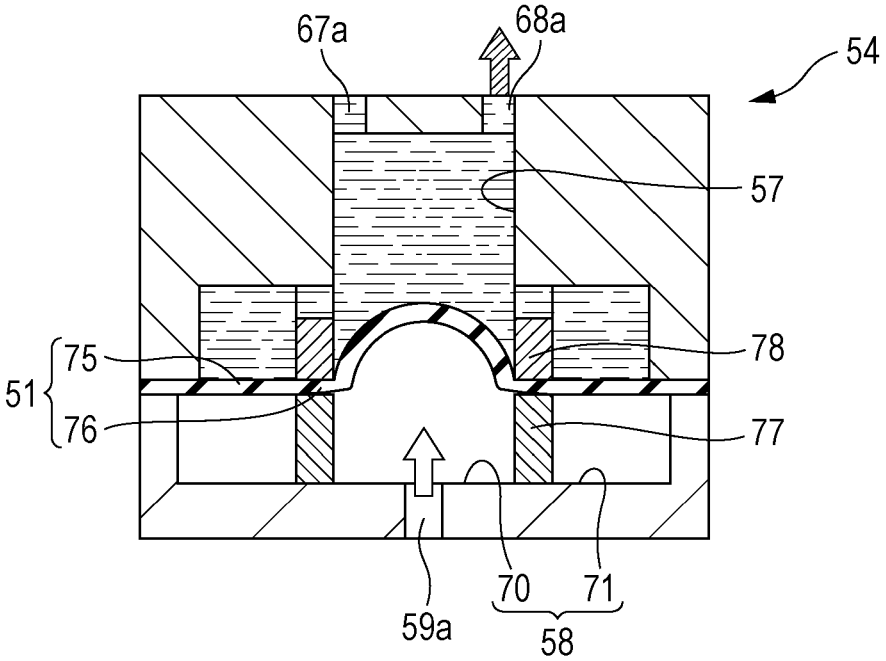
FIG. 7 is a sectional view of the pressure adjustment section illustrating a state in which first pressure cleaning is performed.
Figure 8:
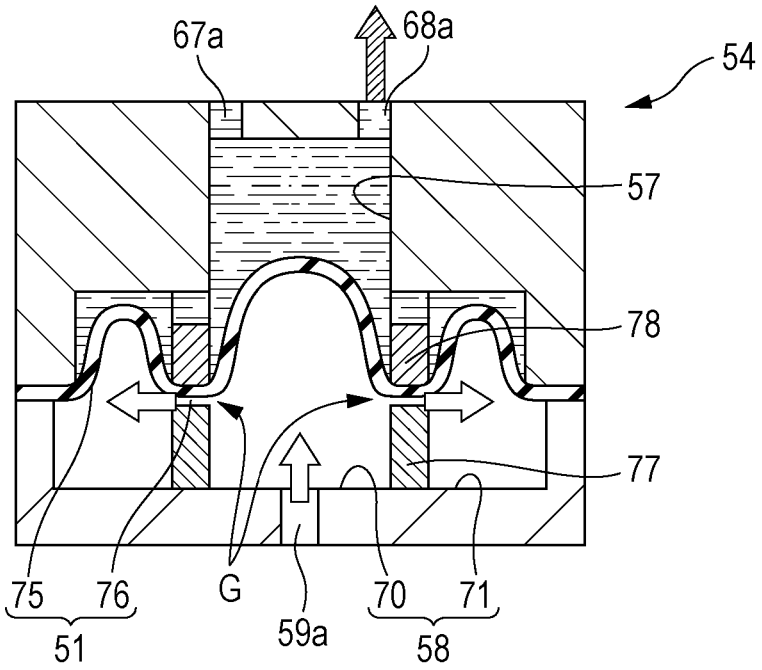
FIG. 8 is a sectional view of the pressure adjustment section illustrating a state in which second pressure cleaning is performed.

FIG. 7 is a sectional view of the pressure adjustment section 54 illustrating a state in which first pressure cleaning is performed, and FIG. 8 is a sectional view of the pressure adjustment section 54 illustrating a state in which second pressure cleaning is performed. The pressure adjustment section 54 according to the present disclosure controls the amount of gas flowing into the fluid chamber 58, that is, controls the driving time of the air pump 16, so that pressure cleaning of a plurality of patterns, in which the discharge amount of the ink from the nozzle 30 is different, can be selectively performed. That is, it is possible to execute the first pressure cleaning of pressurizing the flexible member 51 by the gas flowing into the first fluid chamber 70 in the first state, and the second pressure cleaning of pressurizing the flexible member 51 by the gas flowing into the first fluid chamber 70 and the second fluid chamber 71 in the second state. When such pressure cleaning is performed, the recording head 10 is positioned at the home position, and control is performed such that ink or the like is discharged from each nozzle 30 toward the capping mechanism 11. Further, prior to the pressure cleaning, the flow path opening/closing section 55 is closed. Therefore, in the pressure cleaning, the ink in the liquid chamber 57 is prevented from flowing backward to the flow path opening/closing section 55 side.

In the first pressure cleaning, when the air pump 16 is driven in the above-described normal state to cause the gas to flow from the vent 59*a* into the first fluid chamber 70 of the fluid chamber 58, and the pressure inside the first fluid chamber 70 increases, the seal portion 76 of the flexible member 51 is regulated from being deformed toward the liquid chamber 57 by the regulation member 78. Therefore, as illustrated in FIG. 7, the film 75 of a portion inside the sealed portion, in which the seal portion 76 comes into contact with the support member 77, that is, a portion corresponding to the first fluid chamber 70 is bent and deformed toward the liquid chamber 57. Therefore, a volume of the liquid chamber 57 is reduced to pressurize the ink inside thereof, and the ink in the liquid chamber 57 is sent from the ink outlet 68*a* to the liquid ejecting unit 23 side through the third flow path 68. Therefore, ink or the like in the flow path inside thereof is discharged from each nozzle 30 of the liquid ejecting unit 23 toward the capping mechanism 11. In the first pressure cleaning, the first state, in which the first fluid chamber 70 and the second fluid chamber 71 in the fluid chamber 58 do not communicate with each other, is maintained. As described above, in the first pressure cleaning, the discharge amount of the ink from each nozzle 30 of the recording head 10 becomes a first amount corresponding to a variation of the volume of the liquid chamber 57 due to the deformation of only the film 75 corresponding to the first fluid chamber 70. The first pressure cleaning is executed, for example, for the purpose of removing the foreign matter such as paper dust adhering to the vicinity of the nozzle 30 on the nozzle formation surface.

In the second pressure cleaning, the driving time of the air pump 16 is set longer than that in the first pressure cleaning. When the driving of the air pump 16 is continued exceeding the driving time of the air pump 16 at the time of the first pressure cleaning from the state in which the film 75 of the portion corresponding to the first fluid chamber 70 is pressurized and bent to the liquid chamber 57 side, the pressure inside the first fluid chamber 70 is further increased, and the flexible member 51 is pulled toward the liquid chamber 57 as a whole. Therefore, a film thickness of the seal portion 76 being pressed to the regulation member 78 side gradually decreases. When the pressure inside the fluid chamber 58 exceeds a predetermined threshold, as illustrated in FIG. 8, a gap G is generated between the seal portion 76 and the support member 77. Therefore, the first fluid chamber 70 and the second fluid chamber 71 communicate with each other through the gap G in the second state. In the second state, since the gas from the vent 59*a* also flows into the second fluid chamber 71, the film 75 of the flexible member 51 is pressurized by both the first fluid chamber 70 and the second fluid chamber 71, and the ink in the liquid chamber 57 is in the pressurized state by the deformation of the film 75. That is, the film 75 in the portions corresponding to the first fluid chamber 70 and the film 75 in the portion corresponding to the second fluid chamber 71 are bent and deformed toward the liquid chamber 57. As described above, the volume of the liquid chamber 57 is further reduced and the ink inside the liquid chamber 57 is pressurized by the deformation of the film 75 of the portion corresponding to the first fluid chamber 70 and the deformation of the film 75 of the portion corresponding to the second fluid chamber 71. More ink is sent from the ink outlet 68*a* to the liquid ejecting unit 23 side, and the ink is discharged from each nozzle 30 of the liquid ejecting unit 23. In the second pressure cleaning, the discharge amount of the ink from each nozzle 30 of the recording head 10 becomes a second amount (>first amount) corresponding a sum of a volume fluctuation of the liquid chamber 57 due to the deformation of the film 75 corresponding to the first fluid chamber 70 and a volume fluctuation of the liquid chamber 57 due to the deformation of the film 75 corresponding to the second fluid chamber 71. The second pressure cleaning is executed, for example, for the purpose of removing thickened ink and air bubbles in the flow path inside the recording head 10.

With respect to a maximum value of the discharge amount in the pressure cleaning, for example, the top portion of the film 75 deformed toward the liquid chamber 57 comes into contact with the ceiling surface or the like of the liquid chamber 57 to regulate the deformation of the film 75, and thereby the adjustment may be performed. Further, for example, the adjustment may be performed by a sensor for detecting the deformation of the film 75 in the liquid chamber 57, a sensor for detecting the pressure in the fluid chamber 58, or the like.

Figure 9:
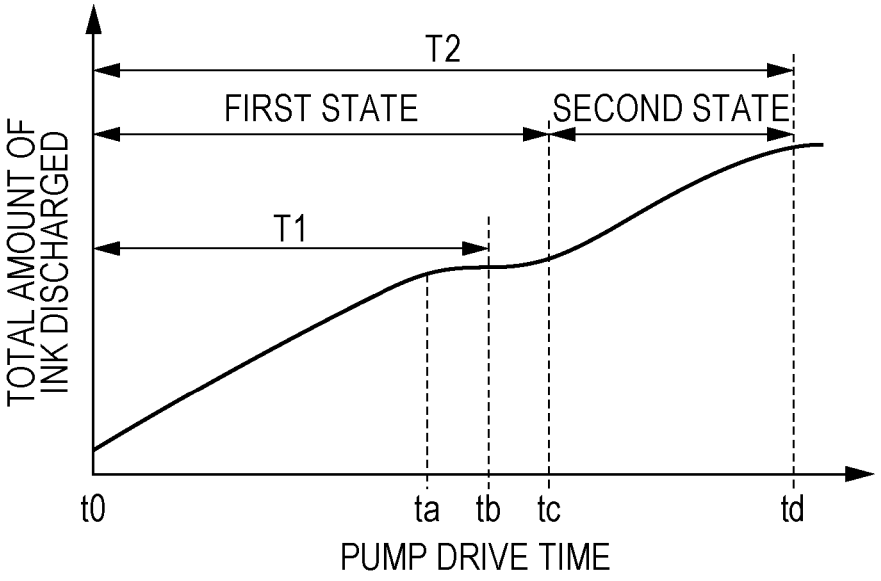
FIG. 9 is a graph for explaining a relationship between a driving time of an air pump and a discharge amount of ink in pressure cleaning.

FIG. 9 is a schematic graph for explaining a relationship between the driving time of the air pump 16 and the discharge amount of the ink from the nozzle 30 in pressure cleaning, and in which a horizontal axis represents the driving time of the air pump 16, and a vertical axis represents the discharge amount, respectively. As illustrated in the drawing, when the driving of the air pump 16 is started in the first state (time point t0), the film 75 corresponding to the first fluid chamber 70 in the flexible member 51 is deformed to the liquid chamber 57 side and the ink is sent from the liquid chamber 57 to the recording head 10 side by pressurization of the inside of the first fluid chamber 70. Therefore, the ink is discharged from each nozzle 30. As the driving of the air pump 16 is continued, the discharge amount of the ink increases at a substantially constant rate, but when the film 75 of the portion described above is deformed to a certain extent, it becomes difficult to deform any more. Therefore, after the time point ta, the increase rate in the discharge amount temporarily decreases.

After that, the driving of the air pump 16 is continued, and at time point tc after time point tb, as described above, the pressure inside the first fluid chamber 70 exceeds the threshold, and a gap is generated between the first seal portion 76 and the support member 77 in the fluid chamber 58. The first fluid chamber 70 and the second fluid chamber 71 communicate with each other through the gap in the second state. Therefore, the flexible member 51 is pressurized by both the film 75 corresponding to the first fluid chamber 70 and the film 75 corresponding to the second fluid chamber 71 in the flexible member 51, and the ink in the liquid chamber 57 is pressurized, so that the discharge amount of the ink increases again at a constant rate as the driving of the air pump 16 is continued. Thereafter, when the film 75 corresponding to the second fluid chamber 71 is deformed to a certain extent, it becomes difficult to deform any more, so that the discharge amount is hardly increased even if the air pump 16 is continuously driven after time point td. In the present embodiment, the driving time of the air pump 16 in the first pressure cleaning is set to a time T1 from time point t0 to time point tb between time point ta and time point tc. Further, the driving time of the air pump 16 in the second pressure cleaning is set to a time T2 from the time point t0 to the time point td. As described above, a region from the time point ta to the time point tc when the increase rate of the discharge amount decreases in the middle of the region where the discharge amount increases at a predetermined rate is generated. Therefore, some error is allowed in setting of the execution time of the first pressure cleaning, that is, the driving time T1 of the air pump 16. Further, in the flexible member 51, for example, the deformation amount of the film 75 may fluctuate according to a temperature change, but in the present embodiment, the area of the film 75 contributing to the pressurization in the first state is smaller than that in the configuration of the related art. Therefore, it is possible to reduce the error in the deformation amount due to the temperature change.

As described above, in the printer 1 according to the present disclosure, two types of pressure cleanings of the first pressure cleaning and the second pressure cleaning in which the discharge amounts of ink are different depending on the driving time of the air pump 16, that is, the supply time of the gas can be executed with a simpler configuration without requiring complicated mechanism, sensor, or the like. Therefore, excess and deficiency of the discharge amount of the ink in the pressure cleaning can be further reduced. In the present embodiment, the seal portion 76 is biased to the support member 77 side by the regulation member 78 which is a type of the bias member, so the sealability between the first seal portion 76 and the support member 77 in the first state can be enhanced. Therefore, the discharge amount of the ink in the pressure cleaning can be adjusted with higher accuracy. In addition, since the first state is converted to the second state when the pressure inside the first fluid chamber 70 exceeds the threshold, switching control of the pressure cleaning with different discharge amounts becomes easy.

In the present embodiment, a configuration, in which the liquid chamber is partitioned by the partition structure 69 into a total of two liquid chambers of the first fluid chamber 70 and the second fluid chamber 71, is illustrated. However, a configuration, in which a third fluid chamber not in direct communication with the first fluid chamber 70 is formed outside the second fluid chamber 71, can also be adopted by providing a plurality of partition structures 69. Therefore, the liquid chamber is partitioned into a total of three or more fluid chambers, and it is possible to execute a plurality of pressure cleanings with different discharge amounts according to the number of the liquid chambers obtained by partitioning. A configuration in which the third fluid chamber is provided will be described later in a fourth embodiment.

Figure 10:
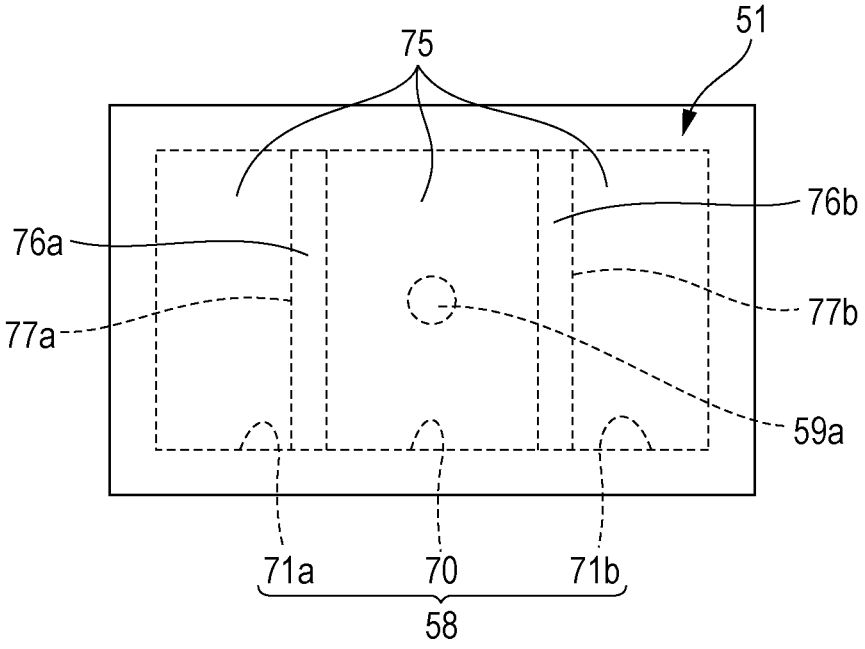
FIG. 10 is a plan view for explaining a configuration of a fluid chamber side in a pressure adjustment section in a second embodiment.
Figure 11:
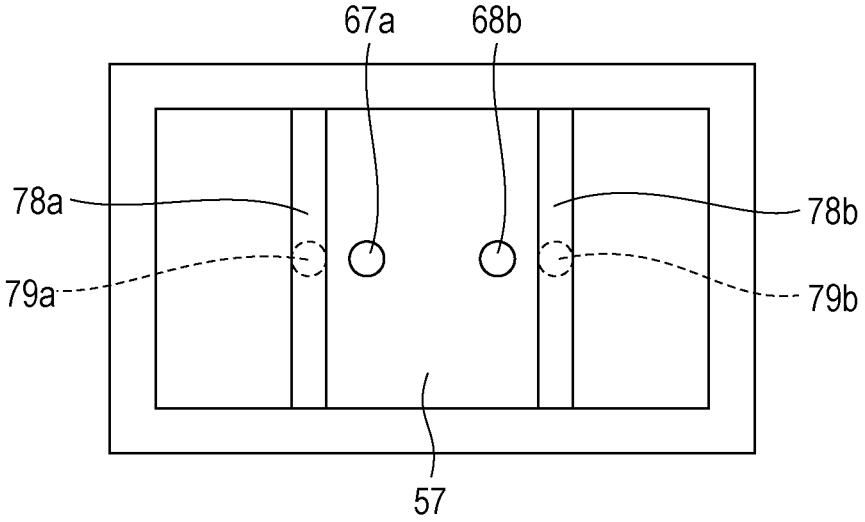
FIG. 11 is a plan view for explaining a configuration of a liquid chamber side in the pressure adjustment section according to the second embodiment.

FIGS. 10 and 11 are plan views illustrating the configuration of the pressure adjustment section 54 according to the second embodiment of the present disclosure, in which FIG. 10 is a plan view for explaining the configuration of the pressure adjustment section 54 on the fluid chamber 58 side, and FIG. 11 is a plan view for explaining the configuration of the pressure adjustment section 54 on the liquid chamber 57 side. The same reference numerals are given to the same portions as in the first embodiment, and the description thereof will be omitted as appropriate. In addition, since the cross section of the pressure adjustment section 54 in the present embodiment is substantially the same as those illustrated in FIGS. 4, 7, and 8.

In the first embodiment, the configuration, in which the fluid chamber 58 and the liquid chamber 57 in a plan view have circular shapes, is illustrated, but the configuration is not limited thereto, and a configuration having a rectangular shape in a plan view can also be adopted as in this embodiment. A flexible member 51 is also formed in a rectangular shape in accordance with the shapes of the fluid chamber 58 and the liquid chamber 57. In the present embodiment, in the fluid chamber 58, seal portions 76*a* and 76*b* as a first seal portion of the flexible member 51 respectively come into contact with two support members 77*a* and 77*b* provided in parallel at intervals on both sides of the vent 59*a* to seal the fluid chamber 58. Therefore, the fluid chambers 58 is configured to be partitioned into three fluid chambers of the first fluid chamber 70 having the vent 59*a* and a total of two second fluid chambers 71*a* and 71*b* provided on both sides thereof. Further, in the liquid chamber 57, two regulation members 78*a* and 78*b* are provided corresponding to the seal portions 76*a* and 76*b* of the flexible member 51, and are urged toward the fluid chamber 58 by the urging members 79*a* and 79*b*, respectively. Therefore, the seal portions 76*a* and 76*b* are respectively pressed, that is, biased to the support members 77*a* and 77*b* of the fluid chamber 58. As described above, in the present embodiment, a total of two sets of partition structures formed of the urging member 79, the seal portion 76, and the support member 77 is provided at different positions. Partitioning provides a plurality of second fluid chambers 71, that is, two second fluid chambers. Details of the urging members 79*a* and 79*b* will be described in a third embodiment.

Similar to the first embodiment, in the second embodiment, as long as the respective partition structures have the same configuration, two patterns of the pressure cleaning, in which the discharge amount of the ink from the nozzle 30 is different, can be performed by controlling the driving time of the air pump 16. That is, the first pressure cleaning of pressurizing the flexible member 51 by the gas flowing into the first fluid chamber 70 in the first state, and the second pressure cleaning of pressurizing the flexible member 51 by the gas flowing into the first fluid chamber 70 and the second fluid chamber 71*a* and 71*b* in the second state can be executed. Further, three pressure cleanings can also be performed with different discharge amounts of ink from the nozzle 30 by making timing, at which the seal between the seal portion 76 and the support member 77 is released, different by changing the configuration of each partition structure. That is, a plurality of pressure cleanings can be executed according to the number of fluid chambers obtained by partitioning by the partition structure.

For example, the timing, at which the seal between the seal portion 76 and the support member 77 is released, can be different for each partition structure by making a thickness of the seal portions 76*a* and 76*b* different for each partition structure. Specifically, a distance between the regulation member 78 and the support member 77 is constant in each partition structure, and a thickness of the seal portion 76*a* is thinner than a thickness of the seal portion 76*b*. Therefore, when the flexible member 51 is pressurized, a gap is more likely to be generated in the seal portion between the seal portion 76*a* and the support member 77*a*, than that in the seal portion between the seal portion 76*b* and the support member 77*b*. As described above, the timing, at which the seal between the support member 77 and the seal portion 76 is released, can be made different for each partition structure depending on the thickness of the seal portion 76. Further, assuming that the thickness of the seal portion 76 is constant in each partition structure, timing for releasing the seal between the seal portion 76 and the support member 77 can be different for each partition structure by making the distance between the regulation member 78 and the support member 77 different each partition structure. That is, for example, when the flexible member 51 is pressurized by making the distance between the regulation member 78*a* and the support member 77*a* larger than the distance between the regulation member 78*b* and the support member 77*b*, a gap is more likely to be generated in the seal portion between the seal portion 76*a* and the support member 77*a* than that in the seal portion between the seal portion 76*b* and the support member 77*b*. Also, in these configurations, it is desirable that the thickness of the seal portion 76 is equal to or greater than the distance between the regulation member 78 and the support member 77 in a state of not coming into contact with any of the support member 77 and the regulation member 78.

Figure 12:
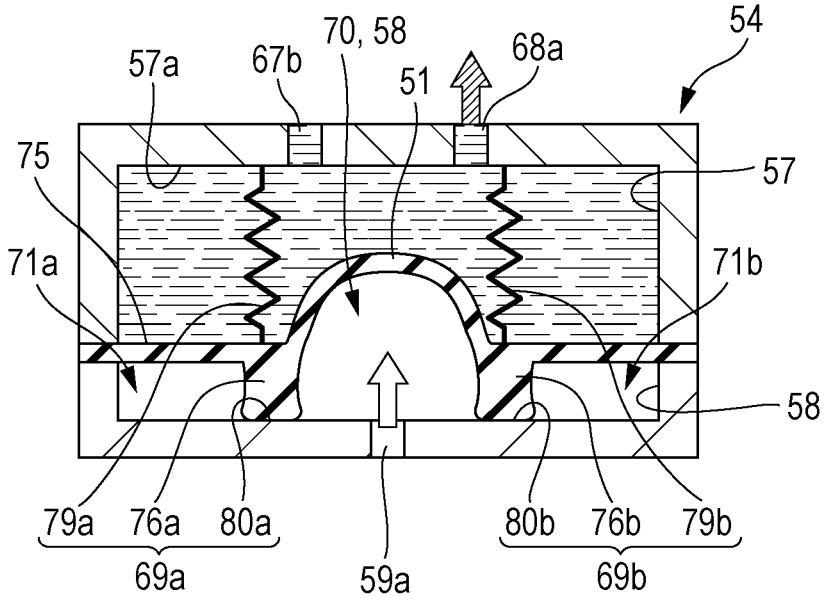
FIG. 12 is a sectional view of a pressure adjustment section illustrating a state in which first pressure cleaning is performed in a third embodiment.
Figure 13:
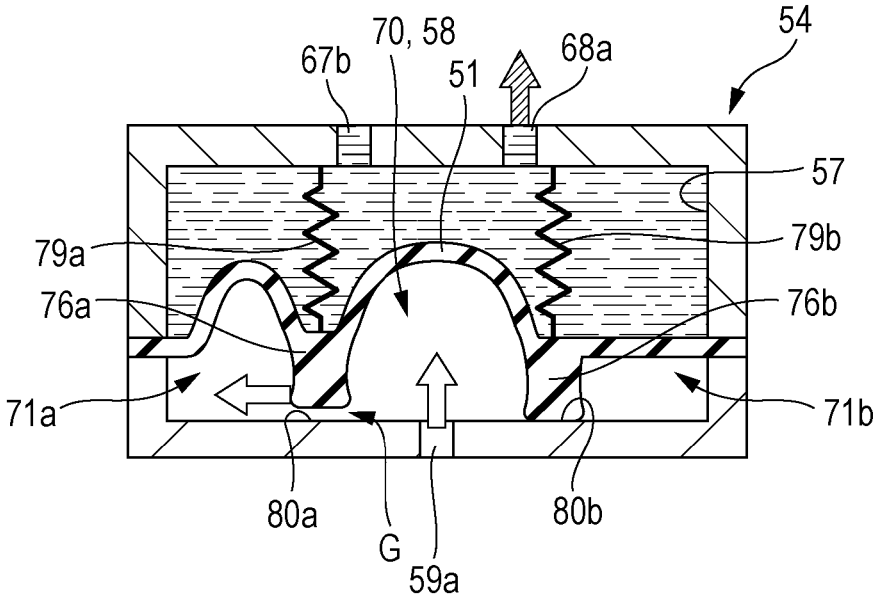
FIG. 13 is a sectional view of a pressure adjustment section illustrating a state in which second pressure cleaning is performed in the third embodiment.
Figure 14:
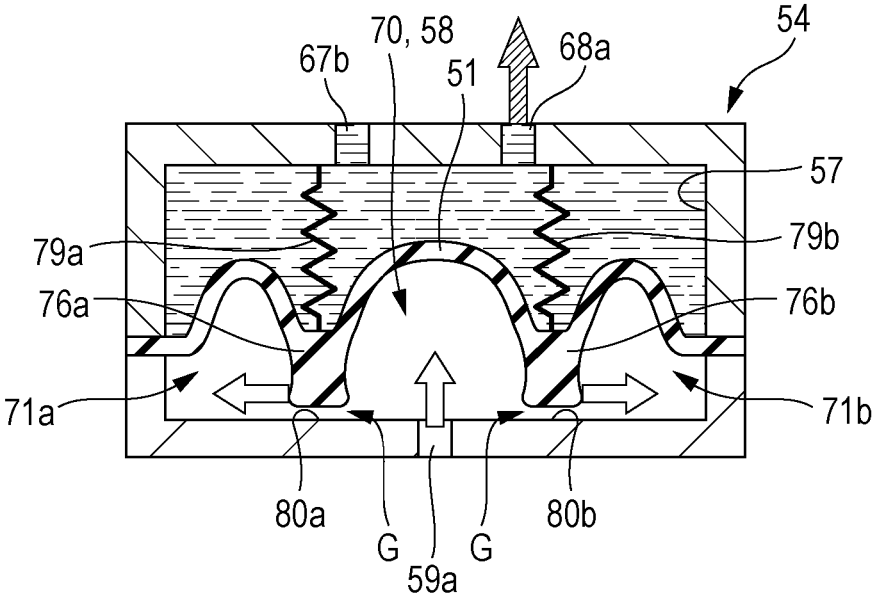
FIG. 14 is a sectional view of a pressure adjustment section illustrating a state in which third pressure cleaning is performed in the third embodiment.

FIGS. 12 to 14 are sectional views for explaining a configuration of a pressure adjustment section 54 in a third embodiment of the present disclosure, in which FIG. 12 illustrates a state in which first pressure cleaning is performed, FIG. 13 illustrates a state in which second pressure cleaning is performed, and FIG. 14 illustrates a state in which third pressure cleaning is performed. The same reference numerals are given to the same portions as in the first and second embodiments, and the description thereof will be omitted as appropriate. In the present embodiment, shapes of a fluid chamber 58 and a liquid chamber 57 in a plan view are rectangular as those in the second embodiment. A thickness of a seal portion 76 of a flexible member 51 in the present embodiment is set thicker than a thickness of a film 75, so that the rigidity of the seal portion 76 is higher than the rigidity of the film 75. The seal portion 76 is integrally formed with a main body (film 75) of the flexible member 51, and is configured by partially increasing the thickness of the flexible member 51. For the seal portion 76, a plurality of films of the same material as the flexible member 51 may be stacked, so that the thickness thereof is thicker than the thickness of the film 75, or the thickness thereof may be thicker than the thickness of the film 75 by joining a material (for example, a material having a rigidity higher than that of a material of the flexible member 51, or the like) different from that of the flexible member 51 or bonding with an adhesive or the like. The flexible member 51 in the present embodiment is provided with two seal portions 76*a* and 76*b* at different positions.

Further, the support member 77 in the first embodiment is not provided in the fluid chamber 58 in the present embodiment, and a bottom surface of the fluid chamber 58 is formed flat. The seal portions 76*a* and 76*b* of the flexible member 51 are in direct contact with the bottom surface of the fluid chamber 58 to seal the fluid chamber 58, so that the fluid chamber 58 is configured to be partitioned into a first fluid chamber 70 and two second fluid chambers 71*a* and 71*b*. Therefore, in the present embodiment, portions in the bottom surface of the fluid chamber 58 coming into contact with the seal portions 76*a* and 76*b* are the support portions 80*a* and 80*b*, respectively, and the support portions 80*a* and 80*b* are the first contact portion in the present disclosure.

Further, in the liquid chamber 57 in the present embodiment, an urging member 79 (a type of the elastic member in the present disclosure) such as a spring of which one end is fixed to the ceiling surface 57*a* is provided as a bias member. As the spring, those of various configurations such as a coil spring, a leaf spring, and an S-shaped spring can be adopted. In the present embodiment, two urging members 79*a* and 79*b* are provided corresponding to the seal portions 76*a* and 76*b* of the flexible member 51. The seal portions 76*a* and 76*b* are urged toward the fluid chamber 58 by the urging members 79*a* and 79*b*. Therefore, the seal portions 76*a* and 76*b* are biased to the fluid chamber 58 side, and respectively come into contact with the support portions 80*a* and 80*b* on the bottom surface of the fluid chamber 58 in the first state to seal the fluid chamber 58. Therefore, in the first state, the fluid chamber 58 is configured to be partitioned into three fluid chambers of the first fluid chamber 70 having the vent 59*a* and the two second fluid chambers 71*a* and 71*b* provided on both sides thereof. That is, the set of the urging member 79*a*, the seal portion 76*a*, and the support portion 80*a*, and the set of the urging member 79*b*, the seal portion 76*b*, and the support portion 80*b* in the present embodiment respectively configure the partition structures 69*a* and 69*b*.

In the present embodiment, the timing, at which the seal between the seal portion 76 and the support portion 80 in each partition structure is released, is made different by changing the configuration of each partition structure 69*a* and 69*b*, and it is possible to perform three pressure cleanings of different discharge amounts of the ink from the nozzle 30. More specifically, the timing, at which the seal between the seal portion 76 and the support member 77 is released, is made different for each partition structure by making spring constants of the urging members 79*a* and 79*b* of the partition structures 69*a* and 69*b* different. That is, when the flexible member 51 is pressurized, a gap is more likely to be generated in the seal portion between the seal portion 76*a* and the support member 77*a* than that in the seal portion between the seal portion 76*b* and the support member 77*b* by making the spring constant of the urging member 79*a* in the partition structure 69*a* smaller than the spring constant of the urging member 79*b* in the partition structure 69*b*.

Also, in the present embodiment, it is possible to perform pressure cleaning of a plurality of patterns, in which the discharge amount of the ink from the nozzle 30 is different, by controlling the driving time of the air pump 16. That is, it is possible to execute the first pressure cleaning of pressurizing the flexible member 51 by the gas flowing into the first fluid chamber 70, the second pressure cleaning of pressurizing the flexible member 51 by the gas flowing into the first fluid chamber 70 and the second fluid chamber 71*a*, and the third pressure cleaning of pressurizing the flexible member 51 by the gas flowing into the first fluid chamber 70, the second fluid chamber 71*a*, and the second fluid chamber 71*b*.

In the first pressure cleaning, when the air pump 16 is driven to cause the gas to flow from the vent 59*a* into the first fluid chamber 70 and the pressure inside the first fluid chamber 70 to increase, as illustrated in FIG. 12, the film 75 corresponding to the first fluid chamber 70 is deformed so as to bend toward the liquid chamber 57. Therefore, a volume of the liquid chamber 57 is reduced to pressurize the ink inside thereof, and the ink in the liquid chamber 57 is sent from the ink outlet 68*a* to the liquid ejecting unit 23 side through the third flow path 68. Therefore, the ink is discharged from the nozzle 30.

When the driving of the air pump 16 is continued exceeding the driving time of the air pump 16 set at the time of the first pressure cleaning from a state in which the film 75 corresponding to the first fluid chamber 70 is pressurized and bent toward the liquid chamber 57, the pressure inside the first fluid chamber 70 is further increased, and the seal portions 76*a* and 76*b* in the partition structures 69*a* and 69*b* are gradually displaced to the liquid chamber 57 side while resisting against a urging force of the urging member 79a. In the present embodiment, as described above, since the spring constant of the urging member 79*a* is smaller than the spring constant of the urging member 79*b*, when the pressure inside the fluid chamber 58 exceeds a first predetermined threshold, as illustrated in FIG. 13, a gap G is previously generated between the seal portion 76*a* and the support portion 80*a* in the partition structure 69*a*. Therefore, the first fluid chamber 70 and the second fluid chamber 71*a* communicate with each other through the gap G in is the second state. In this second state, the gas from the vent 59*a* also flows into the second fluid chamber 71*a*, so the flexible member 51 is pressurized by both the first fluid chamber 70 and the second fluid chamber 71*a* to create a state in which the ink in the liquid chamber 57 is pressurized. Therefore, the second pressure cleaning, in which the discharge amount of the ink is larger than that of the first pressure cleaning, can be performed.

When the driving of the air pump 16 is continued exceeding the driving time of the air pump 16 set at the time of the second pressure cleaning from a state in which the film 75 corresponding to the first fluid chamber 70 and the second fluid chamber 71*a* is pressurized and bent toward the liquid chamber 57, the pressure inside the fluid chamber 58 is further increased, and when the pressure inside the fluid chamber 58 exceeds a second predetermined threshold, as illustrated in FIG. 14, a gap G is generated between the seal portion 76*b* and the support portion 80*b* in the partition structure 69*b*. Therefore, the first fluid chamber 70, the second fluid chamber 71*a*, and the second fluid chamber 71*b* communicate with each other through the gap G in the third state. In the third state, the gas from the vent 59*a* also flows into the second fluid chamber 71*b*, so that the flexible member 51 is pressurized by the three fluid chambers of the first fluid chamber 70, the second fluid chamber 71*a*, and the second fluid chamber 71*b* to create a state in which the ink inside the liquid chamber 57 is pressurized. Therefore, the third pressure cleaning, in which the discharge amount of the ink is larger than that in the second pressure cleaning, can be performed.

In the present embodiment, since the rigidity of the seal portion 76 is higher than the rigidity of the film 75, when the seal portion 76 (76*a* and 76*b*) and the support portion 80 (80*a* and 80*b*) come in contact with each other, the sealability between the first fluid chamber 70 and the second fluid chambers 71*a* and 71*b* is enhanced. Therefore, the discharge amount of the ink in the pressure cleaning can be adjusted with higher accuracy. Further, in the present embodiment, since the seal portion 76 and the support portion 80 are sealed by the urging force of the urging member 79, the timing, at which the seal between the seal portion 76 and the support portion 80 in each partition structure 69*a* and 69*b* is released, can be arbitrarily adjusted by changing the spring constant of the urging member 79. The elastic member in the present disclosure is not limited to the urging member such as a spring, and may be made of, for example, an elastic member such as rubber. In this case, the timing, at which the seal between the seal portion 76 and the support portion 80 in each partition structure is released in each partition structure, is different by changing the elastic modulus of the elastic member for each partition structure, and a plurality of pressure cleanings, in which the discharge amount of the ink from the nozzle 30 is different, can be performed.

Figure 15:
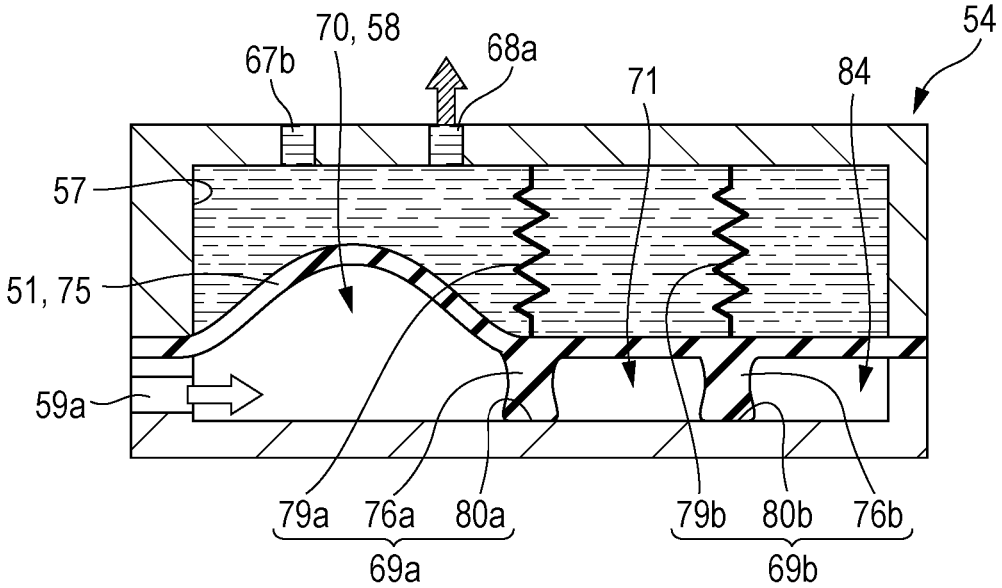
FIG. 15 is a sectional view of a pressure adjustment section illustrating a state in which first pressure cleaning is performed in a fourth embodiment.
Figure 16:
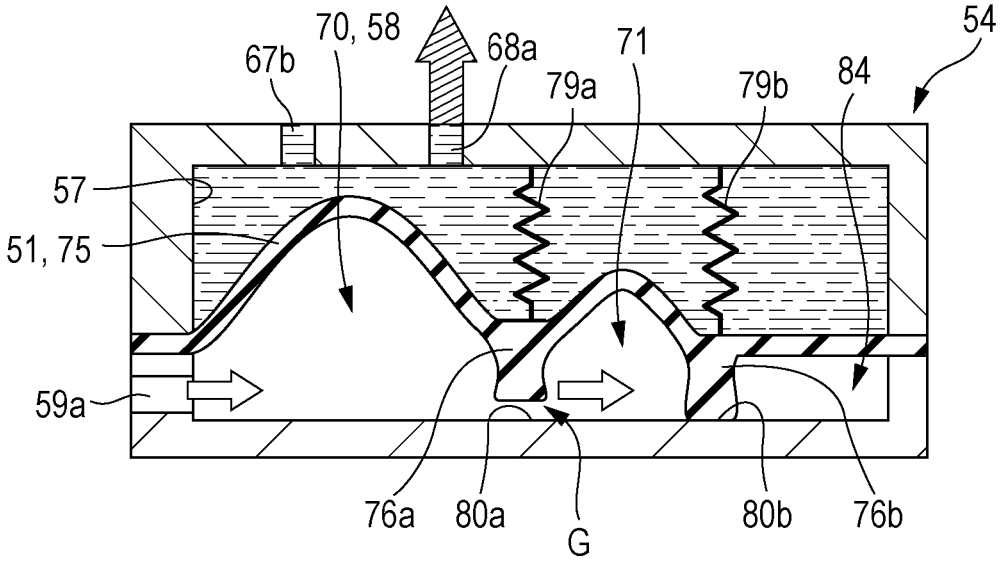
FIG. 16 is a sectional view of the pressure adjustment section illustrating a state in which second pressure cleaning is performed in the fourth embodiment.
Figure 17:
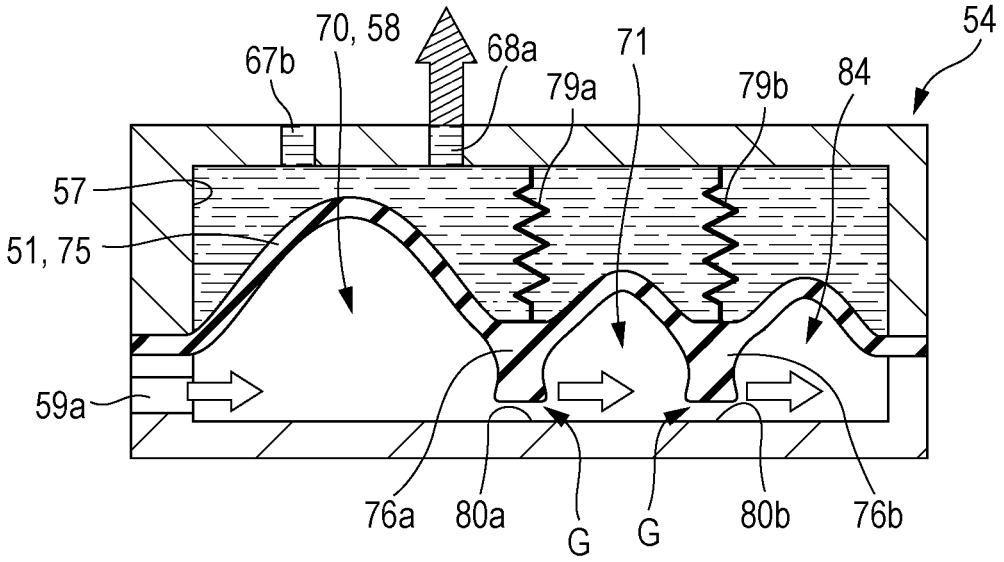
FIG. 17 is a sectional view of the pressure adjustment section illustrating a state in which third pressure cleaning is performed in the fourth embodiment.

FIGS. 15 to 17 are sectional views for explaining a configuration of a pressure adjustment section 54 in a fourth embodiment of the present disclosure, in which FIG. 15 illustrates a state in which first pressure cleaning is performed. FIG. 16 illustrates a state in which second pressure cleaning is performed, and FIG. 17 illustrates a state in which third pressure cleaning is performed. The same reference numerals are given to the same portions as in each of the embodiments described above, and the description thereof will be omitted as appropriate. A flexible member 51 in the present embodiment is provided with a first seal portion 76*a* and a second seal portion 76*b* at a position different from the first seal portion 76*a*, and they are respectively urged by urging members 79*a* and 79*b*. Therefore, the seal portions 76*a* and 76*b* are biased to the fluid chamber 58 side, and respectively come into contact with the support portions 80*a* and 80*b* on the bottom surface of the fluid chamber 58 in the first state to seal the fluid chamber 58.

In the present embodiment, a vent 59*a* is open on a side surface of a fluid chamber 58. Therefore, in the state in which the seal portions 76*a* and 76*b* come into contact with the support portions 80*a* and 80*b* and are sealed (that is, in a first state), it is partitioned into three fluid chambers of a first fluid chamber 70 having the vent 59*a*, a second fluid chamber 71 adjacent to the first fluid chamber 70 via a partition structure 69*a*, and a third fluid chamber 84 (corresponding to the third fluid chamber in the present disclosure) adjacent to the second fluid chamber 71 via a partition structure 69*b* in order from the left in FIG. 15. The third fluid chamber 84 is a fluid chamber not directly adjacent to the first fluid chamber 70. The second seal portion 76*b* in the present embodiment is a type of the second seal portion in the present disclosure, and the corresponding support portion 80*b* is a type of the second contact portion in the present disclosure. The set of the urging member 79*a*, the seal portion 76*a*, and the support portion 80*a*, and the set of the urging member 79*b*, the seal portion 76*b*, and the support portion 80*b* in the present embodiment respectively configure the partition structures 69*a* and 69*b*.

Also, in the present embodiment, it is possible to perform pressure cleaning of a plurality of patterns, in which the discharge amount of the ink from the nozzle 30 is different, by controlling the driving time of the air pump 16. That is, it is possible to execute the first pressure cleaning of pressurizing the flexible member 51 by the gas flowing into the first fluid chamber 70, the second pressure cleaning of pressurizing the flexible member 51 by the gas flowing into the first fluid chamber 70 and the second fluid chamber 71, and the third pressure cleaning of pressurizing the flexible member 51 by the gas flowing into the first fluid chamber 70, the second fluid chamber 71, and the third fluid chamber 84.

In the first pressure cleaning, the air pump 16 is driven to cause the gas to flow from the vent 59*a* opened on the side surface of the fluid chamber 58 into the first fluid chamber 70. When the pressure inside the first fluid chamber 70 increases, as illustrated in FIG. 15, the film 75 corresponding to the first fluid chamber 70 is bent and deformed toward the liquid chamber 57. Therefore, a volume of the liquid chamber 57 is reduced to pressurize the ink inside thereof, and the ink in the liquid chamber 57 is sent from the ink outlet 68*a* to the liquid ejecting unit 23 side through the third flow path 68. Therefore, the ink is discharged from the nozzle 30.

When the driving of the air pump 16 is continued exceeding the driving time of the air pump 16 set at the time of the first pressure cleaning from a state in which the film 75 corresponding to the first fluid chamber 70 is pressurized and bent toward the liquid chamber 57, the pressure inside the first fluid chamber 70 is further increased, and the seal portion 76*a* in the partition structure 69*a* is gradually displaced to the liquid chamber 57 side while resisting against the urging force of the urging member 79*a*. When the pressure inside the fluid chamber 58 exceeds a predetermined first threshold, as illustrated in FIG. 16, a gap G is generated between the seal portion 76*a* and the support portion 80*a* in the partition structure 69*a*. Therefore, the first fluid chamber 70 and the second fluid chamber 71 communicate with each other through the gap G in the second state. In the second state, since the gas from the vent 59*a* also flows into the second fluid chamber 71, the flexible member 51 is pressurized by both the first fluid chamber 70 and the second fluid chamber 71, and the ink inside the liquid chamber 57 is in the pressurized state. Therefore, the second pressure cleaning, in which the discharge amount of the ink is larger than that of the first pressure cleaning, can be performed.

When the driving of the air pump 16 is continued exceeding the driving time of the air pump 16 set at the time of the second pressure cleaning from a state in which the film 75 corresponding to the first fluid chamber 70 and the second fluid chamber 71 is pressurized and bent toward the liquid chamber 57, the pressure inside the fluid chamber 58 is further increased, and exceeds a second threshold, as illustrated in FIG. 17, a gap G is generated between the seal portion 76*b* and the support portion 80*b* in the partition structure 69*b*. Therefore, the first fluid chamber 70, the second fluid chamber 71, and the third fluid chamber 84 communicate with each other through the gap G in the third state. In the third state, the gas from the vent 59*a* also flows into the third fluid chamber 84, so that the pressure member 51 is pressurized by the three fluid chambers of the first fluid chamber 70, the second fluid chamber 71, and the third fluid chamber 84 to create a state in which the ink inside the liquid chamber 57 is pressurized. Therefore, the third pressure cleaning, in which the discharge amount of the ink is larger than that in the second pressure cleaning, can be performed.

The spring constants of the urging members 79 and 89*b* in the present embodiment may be the same or different. In any case, the seal between the seal portion 76*a* and the support portion 80*a* in the partition structure 69*a* may be released first, and then the seal between the seal portion 76*b* and the support portion 80*b* in the partition structure 69*b* may be released later. In the present embodiment, the configuration, in which only one third fluid chamber 84 is obtained by partitioning, is exemplified, but, for example, the third fluid chamber 84 can be partitioned into two or more by further increasing the partitioning structure. Therefore, it possible to execute pressure cleanings of more patterns with different discharge amounts.

Although the structure, in which the bias member, that is, the regulation member 78 and the urging member 79 are provided, is illustrated in each embodiment, if the seal can be taken between the seal portion 76 and the support member 77, or between the seal portion 76 and the support portion 80, the bias member is not an essential part. Further, the bias member is not limited to the regulation member 78 and the urging member 79 exemplified in each embodiment, but it is also possible to adopt, for example, a bias member that biases the seal portion to the contact portion of the fluid chamber by a magnetic force. That is, a configuration, in which magnets having mutually different polarities are provided in the seal portion and the contact portion, can be adopted. Alternatively, it is also possible to adopt a configuration in which a magnet is provided in either the seal portion or the contact portion, and a magnetic material capable of being adsorbed to the magnet is provided on the other side. In this case, the timing, at which the seal between the seal portion and the contact portion is released, can be arbitrarily adjusted by changing the magnetic force for each of a plurality of partition structures.

Also, for example, a configuration can be provided, in which a plurality of films 75 with different thicknesses (or different in rigidity) are provided in the flexible member 51, the flexible member 51 is in a state (most thereof may come into contact therewith and also includes partially separated) of entirely coming into contact with the bottom surface of the fluid chamber 58 in the first state, and when the gas is supplied to the fluid chamber 58 to pressurize the inside thereof in the pressure cleaning, the film 75 with low rigidity is first deformed, and then the film 75 with high rigidity starts to deform. Therefore, it is possible to execute a plurality of pressure cleanings with different discharge amounts of liquid.

Although the ink jet recording head 10 which is a type of the liquid injection head is explained as an example above, the present disclosure can also be applied to another liquid ejecting head which has a pressure adjustment part, and a liquid ejecting apparatus provided with the liquid ejecting head. For example, the present disclosure can be applied to a color material ejecting head used for manufacturing a color filter such as a liquid crystal display, an electrode material ejecting head used to form an electrode such as an organic electro luminescence (EL) display or a surface emitting display (FED), and a liquid ejecting head provided with a plurality of bio-organic matter ejecting heads or the like used for manufacturing a biochip (biochemical element), and a liquid ejecting apparatus provided with the same.

In the following, technical ideas and their operational effects which are grasped from the above-described embodiments and modification examples will be described.

The liquid ejecting apparatus according to the present disclosure is proposed to achieve the above object, and includes a liquid ejecting unit ejecting a liquid from a nozzle; and a pressure adjustment section that adjusts a pressure of the liquid supplied to the liquid ejecting unit. The pressure adjustment section includes a liquid chamber communicating with the liquid ejecting unit and storing the liquid to be supplied to a liquid ejecting unit side, a fluid chamber into which a fluid is capable of flowing, a flexible member that includes an elastically deformable film and a first seal portion provided in the film, the flexible member being interposed between the liquid chamber and the fluid chamber to separate the liquid chamber and the fluid chamber, and a pressurizing section that supplies the fluid to the fluid chamber and pressurizes the flexible member toward the liquid chamber with the fluid. The fluid chamber includes a first contact portion configured to come into contact with the first seal portion, and the fluid chamber is configured such that the first contact portion and the first seal portion come in contact with each other so as to be partitioned into a first fluid chamber having an introduction port through which the fluid flows in and a second fluid chamber. The pressurizing section converts, by the supply of the fluid to the fluid chamber, a state of the fluid chamber into a first state in which the first contact portion and the first seal portion are in contact with each other, or a second state in which the contact between the first contact portion and the first seal portion is released so that the first fluid chamber and the second fluid chamber communicate with each other (first configuration).

According to the liquid ejecting apparatus of the present disclosure, it is possible to execute a plurality of pressure cleanings with different discharge amounts of the liquid from each nozzle with a simpler configuration, according to the driving time of the pressurizing section, that is, the supply time of the gas.

In the first configuration, it is possible to adopt a configuration in which the rigidity of the first seal portion is higher than the rigidity of the film (second configuration).

According to the configuration, since the rigidity of the first seal portion is higher than the rigidity of the film, it is possible to enhance the sealability when coming into contact with the first contact portion. Therefore, the discharge amount of the liquid in the pressure cleaning can be adjusted with higher accuracy.

In the first configuration, it is desirable that when a pressure in the first fluid chamber exceeds a threshold, the first state is converted into the second state (third configuration).

According to the configuration, when the pressure in the first fluid chamber exceeds the threshold, the first state is converted into the second state, so that switching control of pressure cleanings with different discharge amounts is easily performed.

Further, in the first configuration, it is desirable to adopt a configuration in which the liquid ejecting apparatus further includes a bias member biasing the first seal portion toward the first contact portion (fourth configuration).

According to the configuration, since the first seal portion is biased toward the first contact portion by the bias member, the sealability when the first seal portion comes into contact with the first contact portion can be enhanced. Therefore, the discharge amount of the liquid in the pressure cleaning can be adjusted with higher accuracy.

Furthermore, in the fourth configuration, it is desirable to adopt a configuration in which the bias member is a regulation member which is provided in the liquid chamber and regulates deformation of the first seal portion toward the liquid chamber, in the first state, the first seal portion comes into contact with the regulation member and the first contact portion so that the first fluid chamber and the second fluid chamber do not communicate with each other, and in the second state, the first seal portion is pressed toward the regulation member, and a gap is generated between the first seal portion and the first contact portion, so that the first fluid chamber and the second fluid chamber communicate with each other through the gap (fifth configuration).

According to the configuration, it is possible to switch between the first state in which the liquid in the liquid chamber is pressurized only by the film in the portion corresponding to the first fluid chamber, and the second state in which the liquid in the liquid chamber is pressurized by the film in the portions corresponding to the first fluid chamber and the second fluid chamber. Therefore, it is possible to perform a plurality of pressure cleanings with different discharge amounts of liquid.

In the fifth configuration, it is desirable to adopt a configuration in which in a state in which the contact between the first contact portion and the regulation member is released, a thickness of the first seal portion is equal to or more than a distance between the regulation member and the first contact portion (sixth configuration).

According to the configuration, the seal portion is in a crushed state between the first contact portion and the regulation member in the first state, and the first fluid chamber and the second fluid chamber can be more reliably blocked.

In the fifth configuration, it is possible to adopt a configuration in which a plurality of sets of partition structures formed of the first contact portion, the first seal portion, and the regulation member are provided at different positions, and the second fluid chamber is partitioned into a plurality of chambers by the plurality of sets of the partition structures (seventh configuration).

According to the configuration, it is possible to execute a plurality of pressure cleanings with different discharge amounts of liquid according to the number of fluid chambers obtained by partitioning.

Furthermore, in the seventh configuration, it is possible to adopt a configuration in which a thickness of the first seal portion is different for each partition structure (eighth configuration).

According to the configuration, the timing, at which the seal between the first contact portion and the first seal portion is released, can be made different for each partition structure according to the thickness of the first seal portion.

Further, in the seventh configuration, it is possible to adopt a configuration in which a distance between the regulation member and the first contact portion is different for each partition structure (ninth configuration).

According to the configuration, the timing, at which the seal between the first contact portion and the first seal portion is released, can be made different for each partition structure according to the distance between the regulation member and the first contact portion.

Furthermore, in the fourth configuration, it is desirable to adopt a configuration in which the bias member is formed of an elastic member that presses the first seal portion toward the first contact portion, in the first state, the elastic member causes the first seal portion and the first contact portion to come into contact with each other, so that the first fluid chamber and the second fluid chamber do not communicate with each other, and in the second state, the first seal portion is moved in a direction to resist an elastic force of the elastic member to create a gap between the first seal portion and the first contact portion, so that the first fluid chamber and the second fluid chamber communicate with each other through the gap (tenth configuration).

According to the configuration, it is possible to switch between the first state in which the liquid in the liquid chamber is pressurized only by the film in the portion corresponding to the first fluid chamber, and the second state in which the liquid in the liquid chamber is pressurized by the film in the portions corresponding to the first fluid chamber and the second fluid chamber. Therefore, it is possible to perform a plurality of pressure cleanings with different discharge amounts of liquid.

In the tenth configuration, it is possible to adopt a configuration in which a plurality of sets of partition structures formed of the first contact portion, the first seal portion, and the elastic member are provided at different positions, and the second fluid chamber is partitioned into a plurality of chambers by the plurality of sets of the partition structures (eleventh configuration).

According to the configuration, it is possible to execute a plurality of pressure cleanings with different discharge amounts of liquid according to the number of fluid chambers obtained by partitioning.

In the eleventh configuration, it is possible to adopt a configuration in which a plurality of elastic members are each constituted by a spring, and a spring constant of the spring is different for each partition structure (twelfth configuration).

According to the configuration, the timing, at which the seal between the first contact portion and the first seal portion is released, can be made different for each partition structure according to the spring constant of the spring which is the elastic member.

Alternatively, in the eleventh configuration, it is possible to adopt a configuration in which the plurality of elastic members are made of rubber, and an elastic modulus of the rubber is different for each partition structure (thirteenth configuration).

According to the configuration, the timing, at which the seal between the first contact portion and the first seal portion is released, can be made different for each partition structure according to the elastic modulus of the rubber which is the elastic member.

Alternatively, in the first configuration, it is possible to adopt a configuration in which the flexible member includes a second seal portion provided at a position different from the first seal portion, the fluid chamber includes a second contact portion configured to come into contact with the second seal portion, and the fluid chamber is configured to be partitioned by the contact between the second contact portion and the second seal portion to obtain a third fluid chamber, the second state is a state in which the second contact portion and the second seal portion come into contact with each other, and the pressurizing section releases the contact between the second contact portion and the second seal portion by the supplying the fluid to the fluid chamber, and converts the second state into a third state in which the second fluid chamber and the third fluid chamber communicate with each other (fourteenth configuration).

According to the configuration, it is possible to switch between the first state in which the liquid in the liquid chamber is pressurized only by the film in the portion corresponding to the first fluid chamber, the second state in which the liquid in the liquid chamber is pressurized by the film in the portions corresponding to the first fluid chamber and the second fluid chamber, and the third state in which the liquid in the liquid chamber is pressurized by the film in the portions corresponding to the first fluid chamber, the second fluid chamber, and the third fluid chamber. Therefore, it is possible to perform a plurality of pressure cleanings with different discharge amounts of liquid.

A maintenance method of the liquid ejecting apparatus of the present disclosure is a maintenance method of the liquid ejecting apparatus including the first configuration, the method including: first pressure cleaning of pressurizing the flexible member by the fluid flowing into the first fluid chamber in the first state; and second pressure cleaning of pressurizing the flexible member by the fluid flowing into the first fluid chamber and the second fluid chamber in the second state, in which the first pressure cleaning and the second pressure cleaning are switched in accordance with a supply time of the fluid by the pressurizing section.

According to the maintenance method, it is possible to execute a plurality of pressure cleanings with different discharge amounts of the liquid from each nozzle with a simpler configuration, according to the driving time of the pressurizing section, that is, the supply time of the gas.

A maintenance method of the liquid ejecting apparatus of the present disclosure is a maintenance method of the liquid ejecting apparatus including the fourteenth configuration, the method including: first pressure cleaning of pressurizing the flexible member by the fluid flowing into the first fluid chamber in the first state; second pressure cleaning of pressurizing the flexible member by the fluid flowing into the first fluid chamber and the second fluid chamber in the second state; and third pressure cleaning of pressurizing the flexible member by the fluid flowing into the first fluid chamber, the second fluid chamber, and the third fluid chamber in the third state, in which the first pressure cleaning, the second pressure cleaning, and the third pressure cleaning are switched in accordance with a supply time of the fluid by the pressurizing section.

According to the maintenance method, it is possible to execute a plurality of pressure cleanings with different discharge amounts of the liquid from each nozzle with a simpler configuration, according to the driving time of the pressurizing section, that is, the supply time of the gas.

In the second configuration, it is desirable to adopt a configuration in which when a pressure in the first fluid chamber exceeds a threshold, the first state is converted into the second state (seventeenth configuration).

According to the configuration, when the pressure in the first fluid chamber exceeds the threshold, the first state is converted into the second state, so that switching control of pressure cleanings with different discharge amounts is easily performed.

Further, in the second configuration, it is desirable to adopt a configuration in which the liquid ejecting apparatus further includes a bias member biasing the first seal portion toward the first contact portion (eighteenth configuration).

According to the configuration, since the first seal portion is biased toward the first contact portion by the bias member, the sealability when the first seal portion comes into contact with the first contact portion can be enhanced. Therefore, the discharge amount of the liquid in the pressure cleaning can be adjusted with higher accuracy.

Further, in the third configuration, it is desirable to adopt a configuration in which the liquid ejecting apparatus further includes a bias member biasing the first seal portion toward the first contact portion (nineteenth configuration).

According to the configuration, since the first seal portion is biased toward the first contact portion by the bias member, the sealability when the first seal portion comes into contact with the first contact portion can be enhanced. Therefore, the discharge amount of the liquid in the pressure cleaning can be adjusted with higher accuracy.

Further, in the seventeenth configuration, it is desirable to adopt a configuration in which the liquid ejecting apparatus further includes a bias member biasing the first seal portion toward the first contact portion (twentieth configuration).

According to the configuration, since the first seal portion is biased toward the first contact portion by the bias member, the sealability when the first seal portion comes into contact with the first contact portion can be enhanced. Therefore, the discharge amount of the liquid in the pressure cleaning can be adjusted with higher accuracy.

What is claimed is:

1. A liquid ejecting apparatus comprising:

a liquid ejecting unit ejecting a liquid from a nozzle; and a pressure adjustment section adjusting a pressure of the liquid to be supplied to the liquid ejecting unit, wherein the pressure adjustment section includes a liquid chamber communicating with the liquid ejecting unit and storing the liquid to be supplied to the liquid ejecting unit, a fluid chamber into which a fluid flows, a flexible member that includes an elastically deformable film and a first seal portion provided in the film, the flexible member being interposed between the liquid chamber and the fluid chamber to separate the liquid chamber and the fluid chamber from each other, and a pressurizing section that supplies the fluid to the fluid chamber and pressurizes the flexible member toward the liquid chamber with the fluid, the fluid chamber is configured such that a first contact portion provided in the fluid chamber and the first seal portion come into contact with each other so as to be partitioned into a first fluid chamber having an introduction port through which the fluid flows in and a second fluid chamber, and the pressurizing section converts, by supplying the fluid to the fluid chamber, a state of the fluid chamber into a first state in which the first contact portion and the first seal portion are in contact with each other, or into a second state in which the contact between the first contact portion and the first seal portion is released so that the first fluid chamber and the second fluid chamber communicate with each other.

2. The liquid ejecting apparatus according to claim 1, wherein rigidity of the first seal portion is higher than rigidity of the film.

3. The liquid ejecting apparatus according to claim 2, wherein when a pressure in the first fluid chamber exceeds a threshold, the first state is converted into the second state.

4. The liquid ejecting apparatus according to claim 2, further comprising:

a bias member biasing the first seal portion toward the first contact portion.

5. The liquid ejecting apparatus according to claim 3, further comprising:

a bias member biasing the first seal portion toward the first contact portion.

6. The liquid ejecting apparatus according to claim 1, wherein when a pressure in the first fluid chamber exceeds a threshold, the first state is converted into the second state.

7. The liquid ejecting apparatus according to claim 6, further comprising:

a bias member biasing the first seal portion toward the first contact portion.

8. The liquid ejecting apparatus according to claim 1, further comprising:

a bias member biasing the first seal portion toward the first contact portion.

9. The liquid ejecting apparatus according to claim 8, wherein the bias member is a regulation member which is provided in the liquid chamber and regulates deformation of the first seal portion toward the liquid chamber, in the first state, the first seal portion comes into contact with the regulation member and the first contact portion so that the first fluid chamber and the second fluid chamber do not communicate with each other, and in the second state, the first seal portion is pressed toward the regulation member, and a gap is generated between the first seal portion and the first contact portion, so that the first fluid chamber and the second fluid chamber communicate with each other through the gap.

10. The liquid ejecting apparatus according to claim 8, wherein the bias member is formed of an elastic member that presses the first seal portion toward the first contact portion, in the first state, the elastic member causes the first seal portion and the first contact portion to come into contact with each other, so that the first fluid chamber and the second fluid chamber do not communicate with each other, and in the second state, the first seal portion is moved in a direction to resist an elastic force of the elastic member to create a gap between the first seal portion and the first contact portion, so that the first fluid chamber and the second fluid chamber communicate with each other through the gap.

11. The liquid ejecting apparatus according to claim 10, further comprising another first contact portion, another first seal portion, and another elastic member, wherein a first partition structure formed of the first contact portion, the first seal portion and the elastic member and a second partition structure formed of the other first contact portion, the other first seal portion and the other elastic member are provided at different positions, and the second fluid chamber is partitioned into a plurality of part chambers by the first and the second partition structure.

12. The liquid ejecting apparatus according to claim 11, wherein the first elastic member is a first spring, the other first elastic member is a second spring, and a spring constant of the first spring is different from a spring constant of the second spring.

13. The liquid ejecting apparatus according to claim 11, wherein the first elastic member is a first rubber, the other first elastic member is a second rubber, and an elastic module of the first rubber is different from an elastic module of the second rubber.

the plurality of elastic members are made of rubber, and an elastic modulus of the rubber is different for each partition structure.

14. The liquid ejecting apparatus according to claim 9, wherein in a state that the contact between the first seal portion and the first contact portion and that the contact between the first seal portion and the regulation member are released, a thickness of the first seal portion is equal to or more than a distance between the regulation member and the first contact portion.

15. The liquid ejecting apparatus according to claim 9, further comprising another first contact portion, another first seal portion, and another regulation member, wherein a first partition structure formed of the first contact portion, the first seal portion and the regulation member and a second partition structure formed of the other first contact portion, the other first seal portion and the other regulation member are provided at different positions, and the second fluid chamber is partitioned into a plurality of part chambers by the first and the second partition structure.

16. The liquid ejecting apparatus according to claim 15, wherein a thickness of the first seal portion is different from a thickness of the other first seal portion.

17. The liquid ejecting apparatus according to claim 15, wherein a distance between the regulation member and the first contact portion is different from a distance between the other regulation member and the other first contact portion.

18. The liquid ejecting apparatus according to claim 1, wherein the flexible member includes a second seal portion provided at a position different from the first seal portion, the fluid chamber is configured such that a second contact portion being provided in the fluid chamber comes into contact with the second seal portion, and the fluid chamber is configured to be partitioned by the contact between the second contact portion and the second seal portion to define a third fluid chamber, the second state is a state in which the second contact portion and the second seal portion come into contact with each other, and the pressurizing section releases the contact between the second contact portion and the second seal portion by supplying the fluid to the fluid chamber, and converts the second state into a third state in which the second fluid chamber and the third fluid chamber communicate with each other.

19. A maintenance method of the liquid ejecting apparatus according to claim 18, the method comprising:

first pressure cleaning of pressurizing the flexible member by the fluid flowing into the first fluid chamber in the first state;

second pressure cleaning of pressurizing the flexible member by the fluid flowing into the first fluid chamber and the second fluid chamber in the second state; and third pressure cleaning of pressurizing the flexible member by the fluid flowing into the first fluid chamber, the second fluid chamber, and the third fluid chamber in the third state, wherein the first pressure cleaning, the second pressure cleaning, and the third pressure cleaning are switched in accordance with a supply time of the fluid by the pressurizing section.

20. A maintenance method of the liquid ejecting apparatus according to claim 1, the method comprising:

first pressure cleaning of pressurizing the flexible member by the fluid flowing into the first fluid chamber in the first state; and second pressure cleaning of pressurizing the flexible member by the fluid flowing into the first fluid chamber and the second fluid chamber in the second state, wherein the first pressure cleaning and the second pressure cleaning are switched in accordance with a supply time of the fluid by the pressurizing section.

* * * * *